US006039839A

United States Patent [19]

Trokhan et al.

[11] Patent Number: 6,039,839

[45] Date of Patent: Mar. 21, 2000

[54] METHOD FOR MAKING PAPER STRUCTURES HAVING A DECORATIVE PATTERN

[75] Inventors: Paul Dennis Trokhan, Hamilton; Dean Van Phan, West Chester; Howard Thomas Deason, Hamilton; Jörg Kleinwächter, Cincinnati, all of Ohio

[73] Assignee: The Procter & Gamble Company, Cincinnati, Ohio

[21] Appl. No.: 09/017,831

[22] Filed: Feb. 3, 1998

[51] Int. Cl.[7] ..... D21F 11/00

[52] U.S. Cl. ..... 162/116; 162/109; 162/206

[58] Field of Search ..... 162/134, 116, 162/109, 113, 115, 206, 112; 428/153, 152, 218, 326; 536/56

[56] References Cited

U.S. PATENT DOCUMENTS

| | | | |
|---|---|---|---|
| 795,719 | 7/1905 | Motz . | |
| 3,025,585 | 3/1962 | Griswold | 28/1 |
| 3,034,180 | 5/1962 | Greiner et al. | 19/155 |
| 3,159,530 | 12/1964 | Heller et al. | 162/348 |
| 3,301,746 | 1/1967 | Sanford et al. | 162/113 |
| 3,322,617 | 5/1967 | Osborne | 162/296 |
| 3,549,742 | 12/1970 | Benz | 264/250 |
| 3,905,863 | 9/1975 | Ayers | 162/113 |
| 3,974,025 | 8/1976 | Ayers | 162/113 |
| 3,994,771 | 11/1976 | Morgan et al. | 162/113 |
| 4,191,609 | 3/1980 | Trokhan | 162/113 |
| 4,225,382 | 9/1980 | Kearney et al. | 162/111 |
| 4,239,065 | 12/1980 | Trokhan | 139/383 |
| 4,300,981 | 11/1981 | Carstens | 162/109 |
| 4,440,597 | 4/1984 | Wells et al. | 162/111 |
| 4,514,345 | 4/1985 | Johnson et al. | 264/22 |
| 4,528,239 | 7/1985 | Trokhan | 428/247 |
| 4,637,859 | 1/1987 | Trokhan | 162/109 |
| 4,919,756 | 4/1990 | Sawdai | 162/111 |
| 4,959,125 | 9/1990 | Spendel | 162/158 |
| 5,059,282 | 10/1991 | Ampulski et al. | 162/111 |
| 5,098,522 | 3/1992 | Smurkoski et al. | 162/358 |
| 5,245,025 | 9/1993 | Trokhan et al. | 536/56 |
| 5,260,171 | 11/1993 | Smurkoski et al. | 430/320 |
| 5,274,930 | 1/1994 | ensign et al. | 34/23 |
| 5,275,700 | 1/1994 | Trokhan | 162/358.1 |
| 5,277,761 | 1/1994 | Phan et al. | 162/109 |
| 5,279,767 | 1/1994 | Phan et al. | 252/357 |
| 5,312,522 | 5/1994 | Phan et al. | 162/111 |
| 5,328,565 | 7/1994 | Rasch et al. | 162/113 |
| 5,334,289 | 8/1994 | Trokhan et al. | 162/358.2 |
| 5,366,785 | 11/1994 | Sawdai | 428/156 |
| 5,407,724 | 4/1995 | Mimura et al. | 428/141 |
| 5,431,786 | 7/1995 | Rasch et al. | 162/348 |
| 5,496,624 | 3/1996 | Stelljes, Jr. et al. | 428/229 |
| 5,500,277 | 3/1996 | Trokhan et al. | 162/296 |
| 5,503,715 | 4/1996 | Trokhan et al. | 162/296 |
| 5,514,523 | 5/1996 | Trokhan et al. | 430/320 |
| 5,520,778 | 5/1996 | Sawdai | 162/115 |
| 5,534,326 | 7/1996 | Trokhan et al. | 428/131 |
| 5,554,467 | 9/1996 | Trokhan et al. | 430/11 |

(List continued on next page.)

FOREIGN PATENT DOCUMENTS

| | | |
|---|---|---|
| 0677612A2 | 10/1995 | European Pat. Off. . |
| WO 96/00812 | 1/1996 | WIPO . |
| WO 96/13635 | 5/1996 | WIPO . |
| WO 96/25547 | 8/1996 | WIPO . |
| WO 96/25555 | 8/1996 | WIPO . |
| WO 96/35018 | 11/1996 | WIPO . |

*Primary Examiner*—Stanley S. Silverman
*Assistant Examiner*—Jose A. Fortuna
*Attorney, Agent, or Firm*—Roddy M. Bullock; Larry L. Huston; E. Kelly Linman

[57] ABSTRACT

A paper web and method of making the paper web are disclosed. The paper web has a background portion and a non-embossed decorative pattern. The decorative pattern has at least one high basis weight region having a basis weight greater than the average basis weight of the surrounding background portion. The decorative pattern can include a number of discrete, decorative indicia. Each decorative indicia can be separated from adjacent decorative indicia by the background portion.

21 Claims, 27 Drawing Sheets

U.S. PATENT DOCUMENTS

| | | | |
|---|---|---|---|
| 5,556,509 | 9/1996 | Trokhan et al. | 162/111 |
| 5,566,724 | 10/1996 | Trokhan et al. | 139/383 |
| 5,580,423 | 12/1996 | Ampulski et al. | 162/111.7 |
| 5,609,725 | 3/1997 | Phan | 162/117 |
| 5,624,790 | 4/1997 | Trokhan et al. | 430/320 |
| 5,628,876 | 5/1997 | Ayers et al. | 162/358.2 |
| 5,629,052 | 5/1997 | Trokhan et al. | 427/508 |
| 5,637,194 | 6/1997 | Ampulski et al. | 162/109 |
| 5,667,636 | 9/1997 | Engel et al. | 162/117 |
| 5,674,663 | 10/1997 | McFarland et al. | 430/320 |
| 5,804,036 | 9/1998 | Phan et al. | 162/116 |

METHOD FOR MAKING PAPER STRUCTURES HAVING A DECORATIVE PATTERN

This patent application cross references the following commonly assigned U.S. Patent Applications:

U.S. Patent Application "Method and Apparatus for Making Cellulosic Fibrous Structures by Selectively Obturated Drainage and Cellulosic Fibrous Structures Produced Thereby, filed Mar. 31, 1995 in the names of Trokhan et al., which is a continuation of Ser. No. 08/066,828 filed May 24, 1993, which is a continuation of Ser. No. 07/722,792 filed Jun. 28, 1991;

U.S. patent application Ser. No. 08/601,910 "Cellulosic Fibrous Structures Having Discrete Regions with Radially oriented Fibers Therein, Apparatus Therefor, and Process of Making, filed Feb. 15, 1996 in the name of Trokhan et al., which is a continuation of Ser. No. 08/163,498 filed Dec. 6, 1993, which is a continuation of Ser. No. 07/922,436 filed Jul. 29 1992;

U.S. patent application Ser. No. 08/710,822 "Cellulosic Fibrous Structures Having at Least Three Regions Distinguished by Intensive Properties, an Apparatus for and a Method of Making Such Cellulosic Fibrous Structures, filed Sep. 23, 1996 in the names of Phan et al., which is a continuation of Ser. No. 08/613,797 filed Mar. 1, 1996, which is a continuation of Ser. No. 08/382,551 filed Feb. 2, 1995, which is a divisional of Ser. No. 07/071,834 filed Jul. 28, 1993, which is a continuation of Ser. No. 07/724,551 filed Jun. 28, 1991; U.S. patent application Ser. No. 08/748,871 "Paper Web Having a Relatively Thinner Continuous Network Region and Discrete Relatively Thicker Regions in the Plane of the Continuous Network Region," filed Nov. 14, 1996 in the name of Phan;

U.S. patent application Ser. No. 08/803,695 "Paper Structures Having at Least Three Regions Including Decorative Indicia Comprising Low Basis Weight Regions", filed Feb. 21, 1997 in the name of Phan and Trokhan.

This patent application incorporates by reference U.S. Pat. No. 5,534,326 issued Jul. 9, 1996 to Trokhan et al.; U.S. Pat. No. 5,245,025 issued Sep. 14, 1993 to Trokhan et al.; U.S. Pat. No. 5,277,761 issued Jan. 11, 1994 to Phan et al.; U.S. patent application Ser. No. 08/748,871 "Paper Web Having a Relatively Thinner Continuous Network Region and Discrete Relatively Thicker Regions in the Plane of the Continuous Network Region," filed Nov. 14, 1996 in the name of Phan; and U.S. patent application Ser. No. 08/803,695 "Paper Structures Having at Least Three Regions Including Decorative Indicia Comprising Low Basis Weight Regions", filed Feb. 21, 1997 in the name of Phan and Trokhan.

FIELD OF THE INVENTION

The present invention relates to paper structures having a decorative pattern, and more particularly to such a paper structure having regions of different basis weight arranged in a predetermined, nonrandom pattern.

BACKGROUND OF THE INVENTION

Cellulosic fibrous structures, such as paper webs, are well known in the art. Such paper webs can be used for facial tissues, toilet tissue, paper towels, bibs, and napkins, each of which is in frequent use today. If these products are to perform their intended tasks and find wide acceptance, the fibrous structure should exhibit suitable properties in terms of absorbency, bulk, strength, and softness. Wet and Dry Tensile strengths are measures of the ability of a fibrous structure to retain its physical integrity during use. Absorbency is the property of the fibrous structure which allows it to retain contacted fluids. Both the absolute quantity of fluid and the rate at which the fibrous structure will absorb such fluid must be considered when evaluating one of the aforementioned consumer products. Further, such paper webs have been used in disposable absorbent articles such as sanitary napkins and diapers.

Attempts have been made in the art to provide paper having two different basis weights, or to otherwise rearrange fibers. Examples include U.S. Pat. No. 795,719 issued Jul. 25, 1905 to Motz; U.S. Pat. No. 3,025,585 issued Mar. 20, 1962 to Griswold; U.S. Pat. No. 3,034,180 issued May 15, 1962 to Greiner et al; U.S. Pat. No. 3,159,530 issued Dec. 1, 1964 to Heller et al; U.S. Pat. No. 3,549,742 issued Dec. 22, 1970 to Benz; and U.S. Pat. No. 3,322,617 issued May 30, 1967 to Osborne.

Separately, there is a desire to provide tissue products having both bulk and flexibility. Improved bulk and flexibility may be provided through bilaterally staggered compressed and uncompressed zones, as shown in U.S. Pat. No. 4,191,609 issued Mar. 4, 1980 to Trokhan, which patent is incorporated herein by reference.

Several attempts to provide an improved foraminous member for making such cellulosic fibrous structures are known, one of the most significant being illustrated in U.S. Pat. No. 4,514,345 issued Apr. 30, 1985 to Johnson et al., which patent is incorporated herein by reference.

Another approach to making tissue products more consumer preferred is to dry the paper structure to impart greater bulk, tensile strength, and burst strength to the tissue products. Examples of paper structures made in this manner are illustrated in U.S. Pat. No. 4,637,859 issued Jan. 20, 1987 to Trokhan, which patent is incorporated herein by reference. U.S. Pat. No. 4,637,859 shows discrete dome shaped protuberances dispersed throughout a continuous network, and is incorporated herein by reference. The continuous network can provide strength, while the relatively thicker domes can provide softness and absorbency.

One disadvantage of the papermaking method disclosed in U.S. Pat. No. 4,637,859 is that drying such a web can be relatively energy intensive and expensive, and typically involves the use of through air drying equipment. In addition, the papermaking method disclosed in U.S. Pat. No. 4,637,859 can be limited with respect to the speed at which the web can be finally dried on the Yankee dryer drum. This limitation is thought to be due, at least in part, to the pattern imparted to the web prior to transfer of the web to the Yankee drum. In particular, the discrete domes described in U.S. Pat. No. 4,637,859 may not be dried as efficiently on the Yankee surface as is the continuous network described in U.S. Pat. No. 4,637,859. Accordingly, for a given consistency level and basis weight, the speed at which the Yankee drum can be operated is limited.

Conventional tissue paper made by pressing a web with one or more press felts in a press nip can be made at relatively high speeds. The conventionally pressed paper, once dried, can then be embossed to pattern the web, and to increase the macro-caliper of the web. For example, embossed patterns formed in tissue paper products after the tissue paper products have been dried are common.

However, embossing processes typically impart a particular aesthetic appearance to the paper structure at the expense of other properties of the structure. In particular, embossing a dried paper web disrupts bonds between fibers in the cellulosic structure. This disruption occurs because the bonds are formed and set upon drying of the embryonic fibrous slurry. After drying the paper structure, moving fibers normal to the plane of the paper structure by embossing breaks fiber to fiber bonds. Breaking bonds results in reduced tensile strength of the dried paper web. In addition, embossing is typically done after creping of the dried paper web from the drying drum. Embossing after creping can disrupt the creping pattern imparted to the web. For instance, embossing can eliminate the creping pattern in some portions of the web by compacting or stretching the creping pattern. Such a result is undesirable because the creping pattern improves the softness and flexibility of the dried web.

PCT Publication WO 96/35018 discloses a paper sheet having a decorative pattern corresponding to areas having a translucent appearance corresponding to a relatively lower basis weight. It is believed that one problem associated with such paper is that tissue paper webs with translucent areas can be considered unfavorable by consumers. For instance, consumers can perceive such low basis weight regions as indicating weakness and/or lack of softness. Further, an excessive amount of low basis weight area can reduce the strength of the paper, making it unsuitable for the task the paper web is intended to perform.

BRIEF SUMMARY OF THE INVENTION

Accordingly, it would be desirable to overcome such problems, and particularly to overcome such problems as they relate to a single lamina of paper. Specifically, it would be desirable to provide a non-through air dried paper web having a decorative pattern without compromising the strength, absorbency, and softness characteristics of the paper web. It would also be desirable to provide a paper web having a non-embossed decorative pattern without requiring translucent areas, as well as such a paper web having a multi-region background, as well as providing a method for forming such a paper web on a conventional, non-through air dry paper without the need for substantial modification of the papermaking machine.

The present invention provides a paper web having a first surface and an oppositely facing second surface. The paper web has a background portion and a non-embossed decorative pattern. The decorative pattern includes at least one high basis weight region having a basis weight which is greater than the average basis weight of the surrounding background portion.

The decorative pattern can comprise one or more low basis weight regions. The relatively low basis weight regions have a basis weight less than the average basis weight of the surrounding background portion, and the low basis weight regions can substantially circumscribe one or more high basis weight regions. At least some of the low basis weight regions can be disposed intermediate the background portion and the high basis weight regions, and at least some of the low basis weight regions can separate adjacent high basis weight regions. By substantially circumscribing one or more high basis weight regions, the low basis weight regions help to accentuate the visual appearance of the decorative indicia.

The term "decorative pattern" as used herein refers to a recognizable shape or shapes imparted to the web, preferably during initial formation of the web. Such shapes include, but are not limited to, floral shapes, animal shapes, geometric shapes, and the like.

The background portion preferably comprises at least 50 percent of the surface area of the first surface of the paper web, and in one embodiment the background portion comprises at least 70 percent of the first surface of the paper web.

In one embodiment, the decorative pattern can comprise less than about 500 decorative indicia per square foot of the web. The pattern can comprise between about 1 and about 300 discrete decorative indicia per square foot of the web, more preferably between about 1 and about 200 discrete decorative indicia per square foot, and even more preferably between about 10 and about 75 decorative indicia per square foot of the web.

The background portion can have an average basis weight of at least about 12 grams per square meter, and in one embodiment the background portion can have an average basis weight of at least about 15 grams per square meter. The decorative pattern can include at least one high basis weight region having a basis weight which is at least about 1.25 times the average basis weight of the surrounding background portion. The high basis weight regions of the decorative pattern preferably comprise less than 30 percent of the first surface of the paper web.

The background portion preferably has an opacity of at least about 2.8, and more preferably at least about 3.0. The opacity is measured using a procedure set forth below. At least a portion of the decorative pattern preferably has an opacity greater than the opacity of the background portion.

In one embodiment, the paper web has a total tensile strength of at least about 250 grams per inch, more preferably at least about 400 grams per inch; a machine direction elongation of at least about 8 percent, and a cross-machine direction elongation of at least about 4 percent, preferably at least about 6 percent. The paper web can have a dry burst strength of at least about 75 grams, preferably at least about 120 grams. In one embodiment, the ratio of the burst strength to the total tensile strength is at least about 0.3. Such a paper web provides the aesthetic benefits associated with a decorative pattern without sacrificing strength and elongation properties. The total tensile strength, elongation, and burst strength are measured using procedures set forth below.

The background portion preferably comprises at least two regions disposed in a nonrandom, repeating pattern and distinguishable from each other by at least one property, such as basis weight, density, or fiber composition. In one embodiment, the background portion comprises at least two regions distinguishable from each other by basis weight. Such a multiple basis weight background portion is believed to enhance the elongation properties of the web, and increase the ratio of burst strength to total tensile strength.

Two or more paper webs having a background portion and decorative pattern having at least one high basis weight region can be joined together to provide a multiple ply paper product.

The present invention also provides a method for making a paper web having a background portion and a decorative pattern which includes at least one high basis weight region. The method includes the steps of: providing a plurality of cellulosic fibers suspended in a liquid carrier, such as water; providing a fiber retentive forming element having liquid pervious zones; and depositing the cellulosic fibers and the liquid carrier onto the forming element. The method further includes the steps of draining the liquid carrier through the forming element in at least two simultaneous stages to form a web having a background portion and a decorative pattern which includes at least one high basis weight region having a basis weight greater than the average basis weight of the surrounding background portion.

The method can further include the steps of providing a web support apparatus having a web patterning surface; transferring the web from the forming element to the web patterning surface of the web support apparatus; and selectively densifying at least a portion of the web to provide a continuous network, high density region and discrete, relatively low density regions.

BRIEF DESCRIPTION OF THE DRAWINGS

While the Specification concludes with claims particularly pointing out and distinctly claiming the present invention, it is believed the invention is better understood from the following description taken in conjunction with the associated drawings, in which like elements are designated by the same reference numeral and:

DETAILED DESCRIPTION OF THE INVENTION

Figure 1:
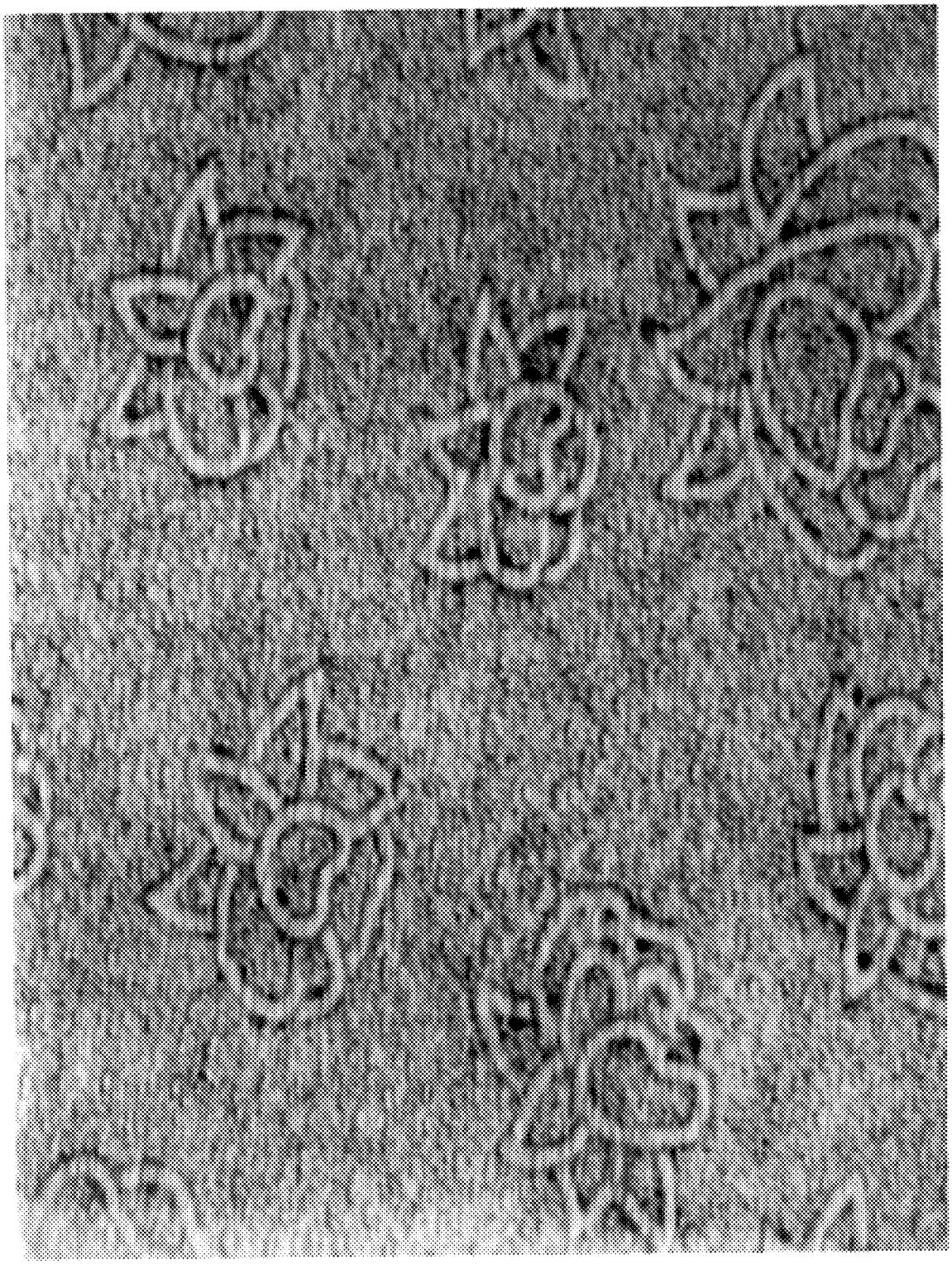
FIG. 1 is a photograph of a portion of a paper web made according to one embodiment of the present invention.
Figure 2:
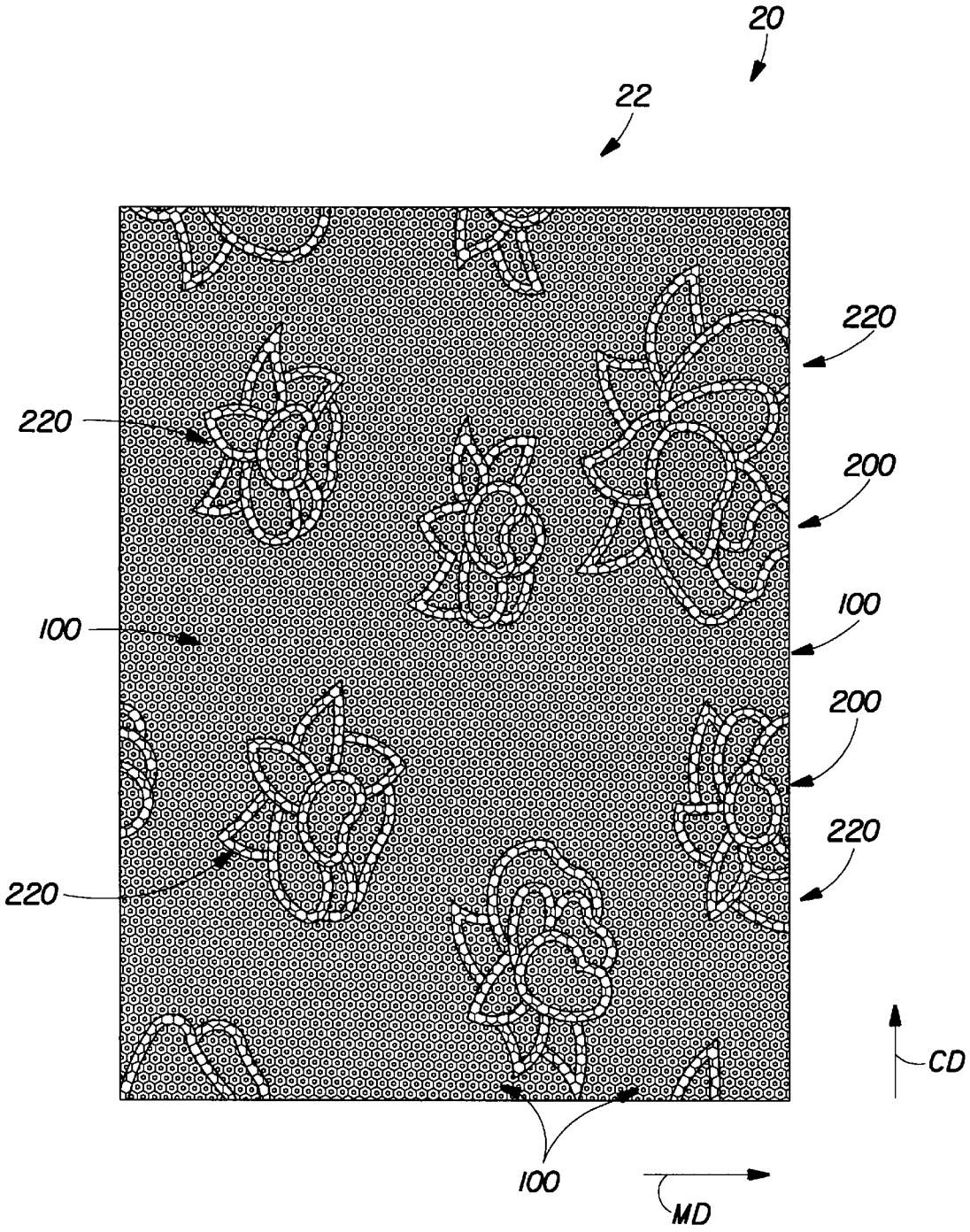
FIG. 2 is a schematic illustration of the paper web shown in FIG. 1.
Figure 3:
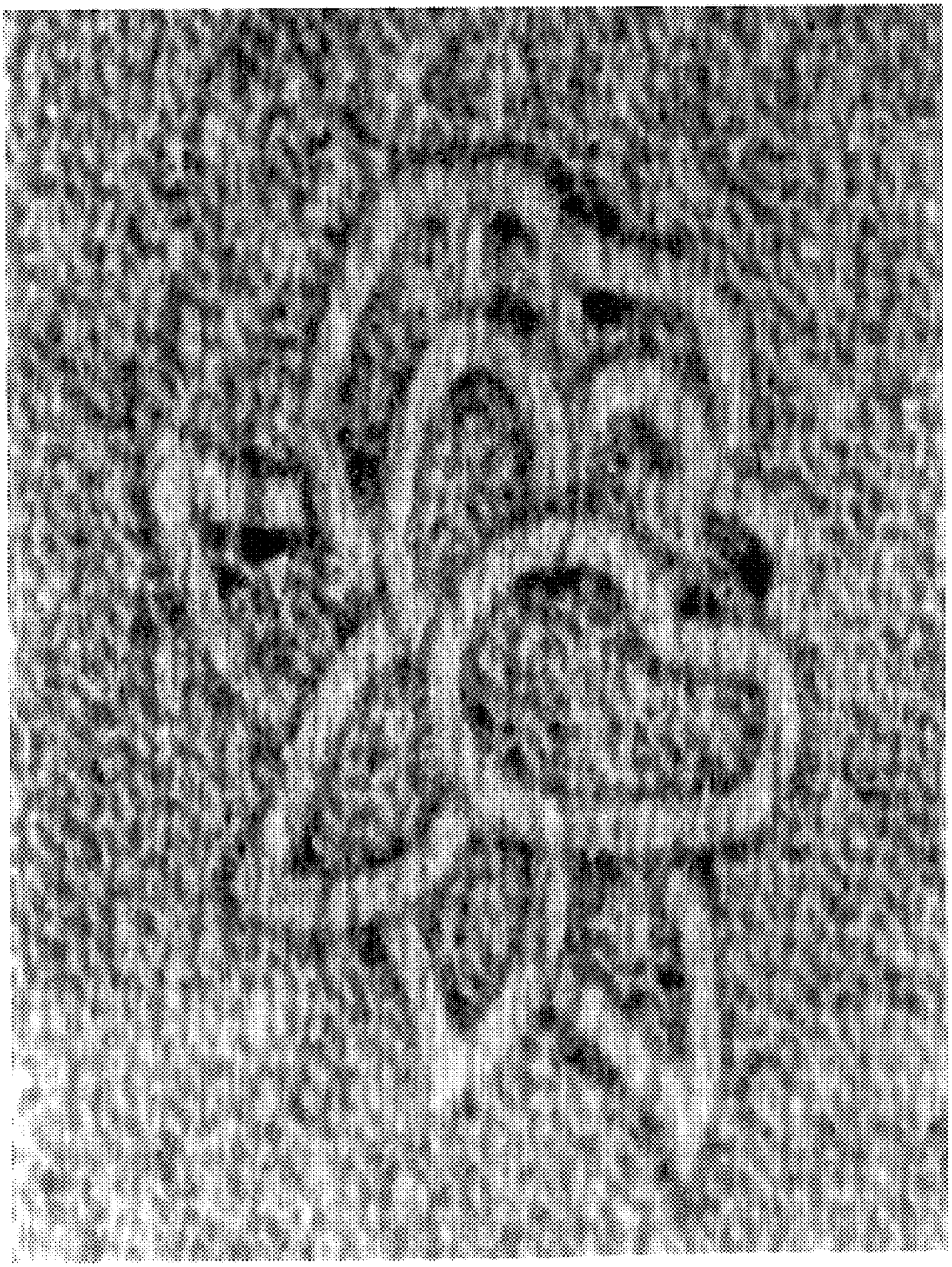
FIG. 3 is an photographic enlargement of the type of paper web shown in FIG. 1.
Figure 4:
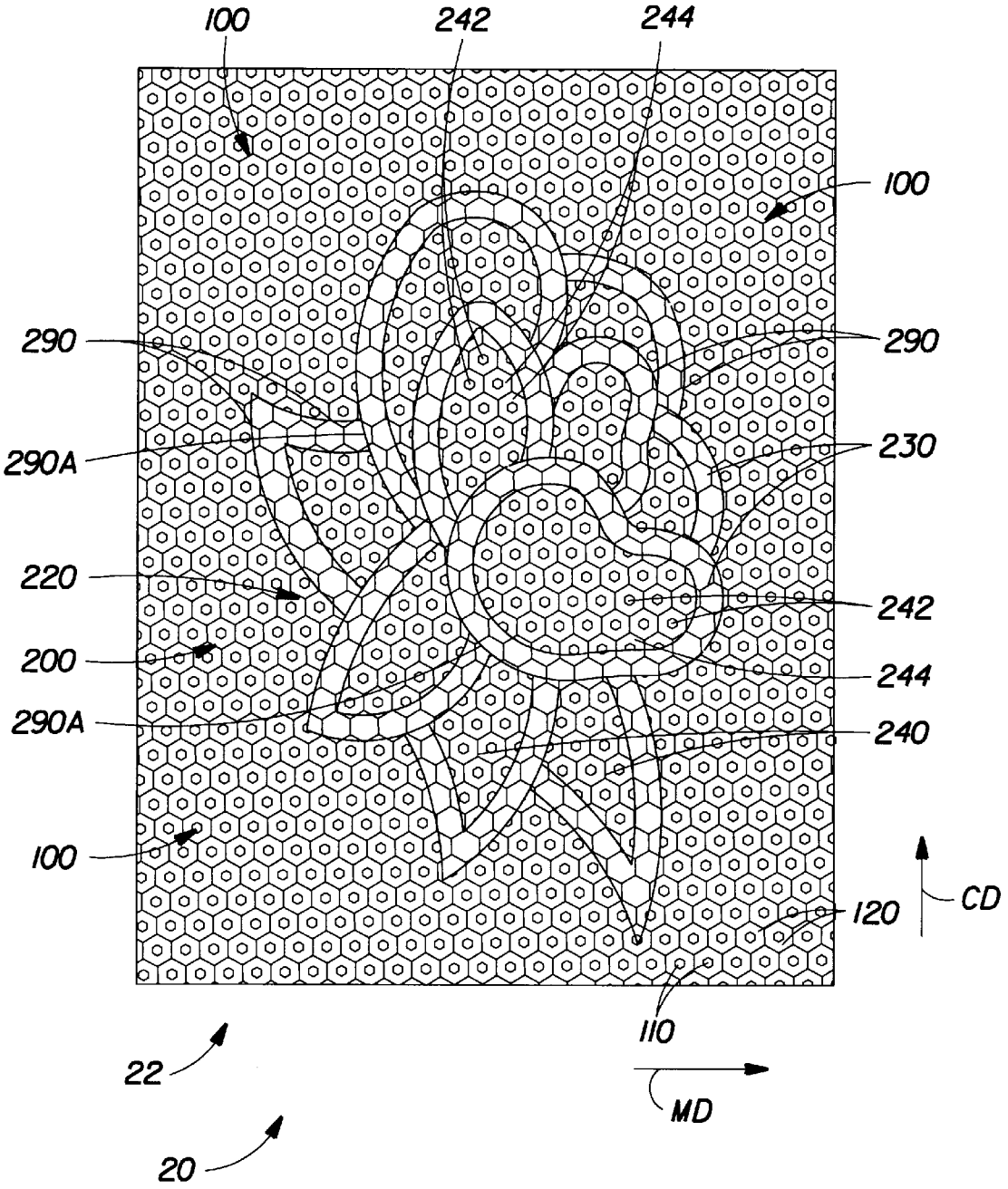
FIG. 4 is a schematic illustration of the photograph of FIG. 3.
Figure 5:
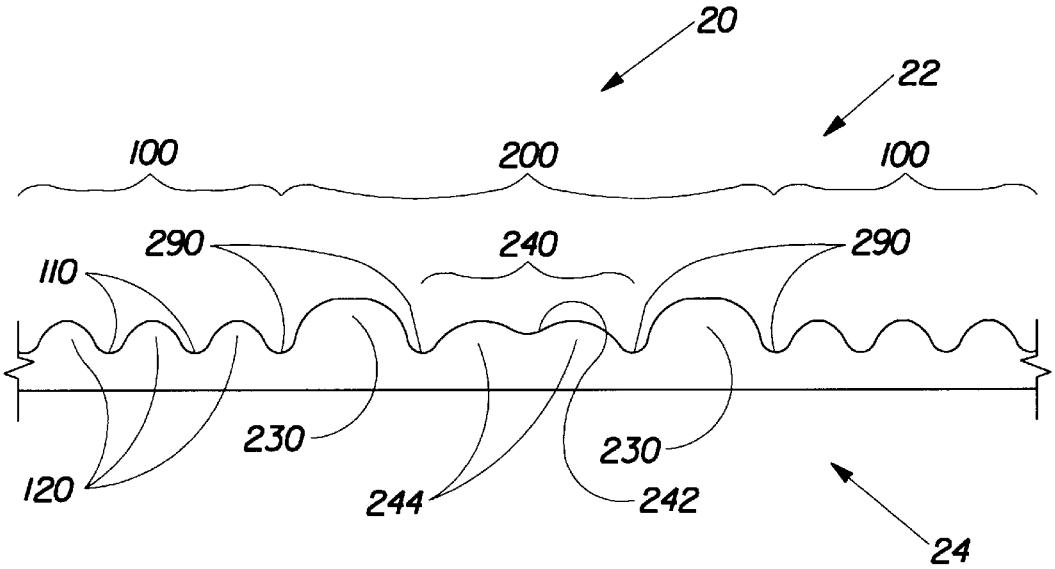
FIG. 5 is a cross-sectional schematic illustration of a portion of a paper web of the type shown in FIG. 4.

FIGS. 1–4 illustrate a paper web 20 made according to one embodiment of the present invention. FIG. 1 is a photograph of the paper web 20. FIG. 2 is a schematic illustration of the paper web shown in FIG. 1. FIG. 3 is a photograph showing an enlarged portion of the type of paper web shown in FIG. 1, and FIG. 4 is a schematic illustration of the paper web shown in FIG. 3. FIG. 5 is a cross-sectional illustration of a paper web of the type shown in FIG. 4, taken along lines 5—5 in FIG. 4. The paper web is wetlaid, and can be nonembossed, being substantially free of dry embossments.

The paper 20 may be foreshortened, as is known in the art. Foreshortening can be accomplished by creping the paper from a rigid surface, and preferably from a cylinder. A Yankee drying drum is commonly used for this purpose. Creping is accomplished with a doctor blade as is well known in the art. Creping may be accomplished according to commonly assigned U.S. Pat. No. 4,919,756, issued Apr. 24, 1992 to Sawdai, the disclosure of which is incorporated herein by reference. Alternatively or additionally, foreshortening may be accomplished via wet microcontraction as taught in commonly assigned U.S. Pat. No. 4,440,597, issued Apr. 3, 1984 to Wells et al., the disclosure of which is incorporated herein by reference. WO 9613635 published May 9, 1996 in the name of Engel et al. and U.S. Pat. No. 5,667,636 issued Sep. 16, 1997 to Engel et al. are incorporated herein by reference for the purpose of disclosing gap transfers for providing foreshortening.

Referring to FIGS. 1–5, the paper web 20 has first and second oppositely facing surfaces 22 and 24, respectively. The paper web 20 comprises a background portion indicated by reference number 100, and a nonembossed decorative pattern indicated by reference number 200.

The background portion 100 can comprise at least 50 percent of the surface area of the first surface 22, as viewed FIG. 2. In one embodiment, the background portion 100 comprises at least 70 percent of the surface area of surface 22.

The term "decorative pattern" as used herein refers to a recognizable shape or shapes imparted to the web, preferably during intial formation of the web. A decorative pattern can be continuous, such as in the form of a continuous network shape; discontinuous, such as in the form of discrete shapes; or semicontinuous (e.g. continuous in one direction, such as along the machine or cross-machine direction of the web 20.) The decorative pattern 200 can be imparted to the web by selective drainage of water from the web during formation of the web, as described in more detail below.

In FIGS. 1–4, the nonembossed decorative pattern 200 comprises a plurality of discrete, decorative indicia 220. In one embodiment, the decorative pattern can comprise less than about 500 decorative indicia per square foot of the web. The pattern can comprise between about 1 and about 300 discrete decorative indicia per square foot of the web, more preferably between about 1 and about 200 discrete decorative indicia per square foot, and even more preferably between about 10 and about 75 decorative indicia per square foot of the web.

Each discrete, decorative indicia 220 is separated from adjacent decorative indicia 220 by the background portion 100. The decorative pattern 200 comprises at least one high basis weight region having a basis weight which is greater than the surrounding background portion 100.

In FIGS. 3 and 4, each decorative indicia 220 comprises a plurality of high basis weight regions 230 which, together, form a border defining the shape of the decorative indicia 220. The decorative indicia 220 in FIGS. 3 and 4 include a plurality of cells 240 substantially enclosed by the border formed by the high basis weight regions 230. The high basis weight regions 230 can have a basis weight that is greater than the average basis weight of each cell 240. The average basis weight of each cell 240 can be substantially equal to the average basis weight of the background portion 100.

The paper web 20 can comprise at least three regions disposed in a nonrandom, repeating pattern, the regions being distinguishable from each other by at least one property selected from the group consisting of basis weight, density, thickness, and fiber composition. In FIGS. 3 and 4, the background portion 100 comprises a plurality of first background regions 110, at least one second background region 120. The regions 110 and 120 are distinguishable from each other by basis weight. The basis weight of the regions 110 is less than the basis weight of the region 120. In FIGS. 3 and 4, the regions 110 are generally discrete, and are substantially encircled by a continuous network region 120.

In FIG. 3, the cells 240 each comprise a plurality of first cell regions 242 and at least one second cell region 244. The regions 242 and 244 are distinguishable from each other by basis weight. The basis weight of the regions 242 is less than the basis weight of the regions 244. In FIGS. 3 and 4, the regions 242 are generally discrete, and are substantially encircled by a continuous network region 244. Each cell 240 is substantially encircled by one or more high basis weight regions 230.

The basis weight of high basis weight regions 230 is measured using the procedure described below under "Measurement of high basis weight regions." The average basis weight of the background 100 and the average basis weight of the cells 240 is measured using the procedure provided below under "Measurement of average basis weight."

These are generally "macro measurements of basis weight." The basis weight of individual regions within the background 100 and the cells 240, such as regions 110, 120, 242, and 244 (micro measurement of basis weight), is measured according to the procedure set forth in U.S. Pat. No. 5,503,715 issued Apr. 2, 1996 to Trokhan et al., which patent is incorporated herein by reference.

The decorative pattern 200 can comprise one or more low basis weight regions. In FIGS. 3 and 4, the decorative indicia 220 comprise low basis weight regions 290 and 290A. Low basis weight regions 290 and 290A have a basis weight less than the average basis weight of the surrounding background portion. The low basis weight regions 290 and 290A can substantially circumscribe one or more high basis weight regions 230. The low basis weight regions 290 form a border intermediate either the background portion 100 or a cell 240. The low basis weight regions form a border intermediate adjacent high basis weight regions. By substantially circumscribing one or more high basis weight regions, the low basis weight regions 290 and 290A help to accentuate the visual appearance of the decorative indicia.

FIG. 5 provides a cross-sectional illustration of the different basis weight regions of the paper web 20. The basis weights of different portions of the web are indicated by different thickness in FIG. 5. The background portion 100 can have an opacity of at least about 3.0. The cells 240 can have an opacity of at least about 3.0. The high basis weight regions 230 have an opacity which is greater than that of the background portion and the cells 240, and the high basis weight regions 230 preferably have an opacity which is at least about 4.0. The first surface 22 can have a visible surface texture, and can have a surface smoothness value of at least 900. The web 20 can have a surface smoothness ratio of at least about 1.2. The surface smoothness and smoothness ratio are measured as set forth below in "Test Methods."

The paper structure 20 can be selectively densified to provide a nonrandom, repeating pattern of density variation. The paper structure 20 can be selectively densified as described in more detail below. In one embodiment, the paper structure comprises a nonrandom, repeating pattern of relatively high and low density regions superimposed with at least one of: the high basis weight regions 230, the background 100, or the cells 240. In particular, the paper structure 20 can comprise a relatively high density, continuous network region and discrete, relatively low density regions dispersed throughout the relatively high density continuous network region.

Figure 6:
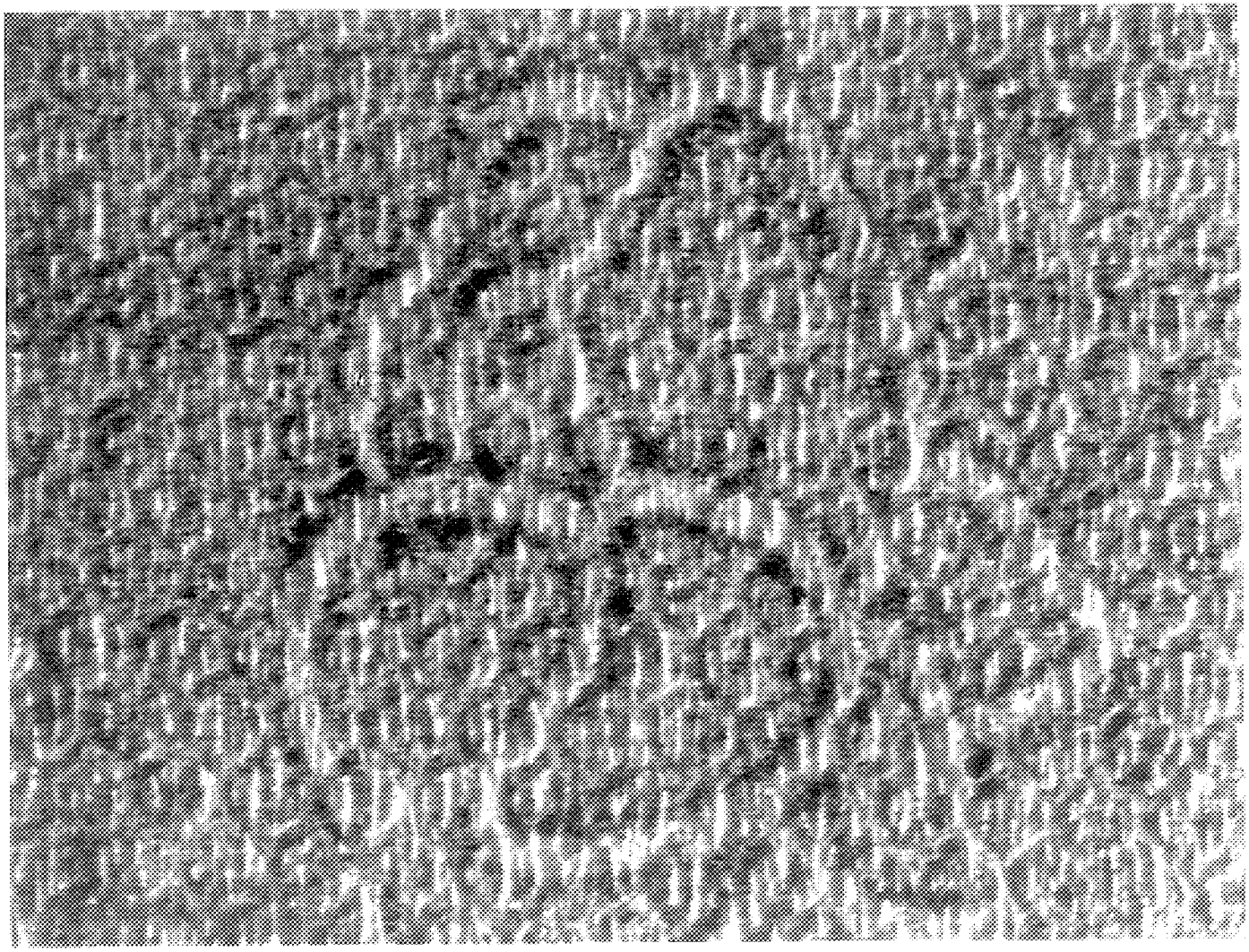
FIG. 6 is a photograph of a portion of a paper web of the type shown in FIG. 1 showing the paper web to have a continuous network region.
Figure 7:
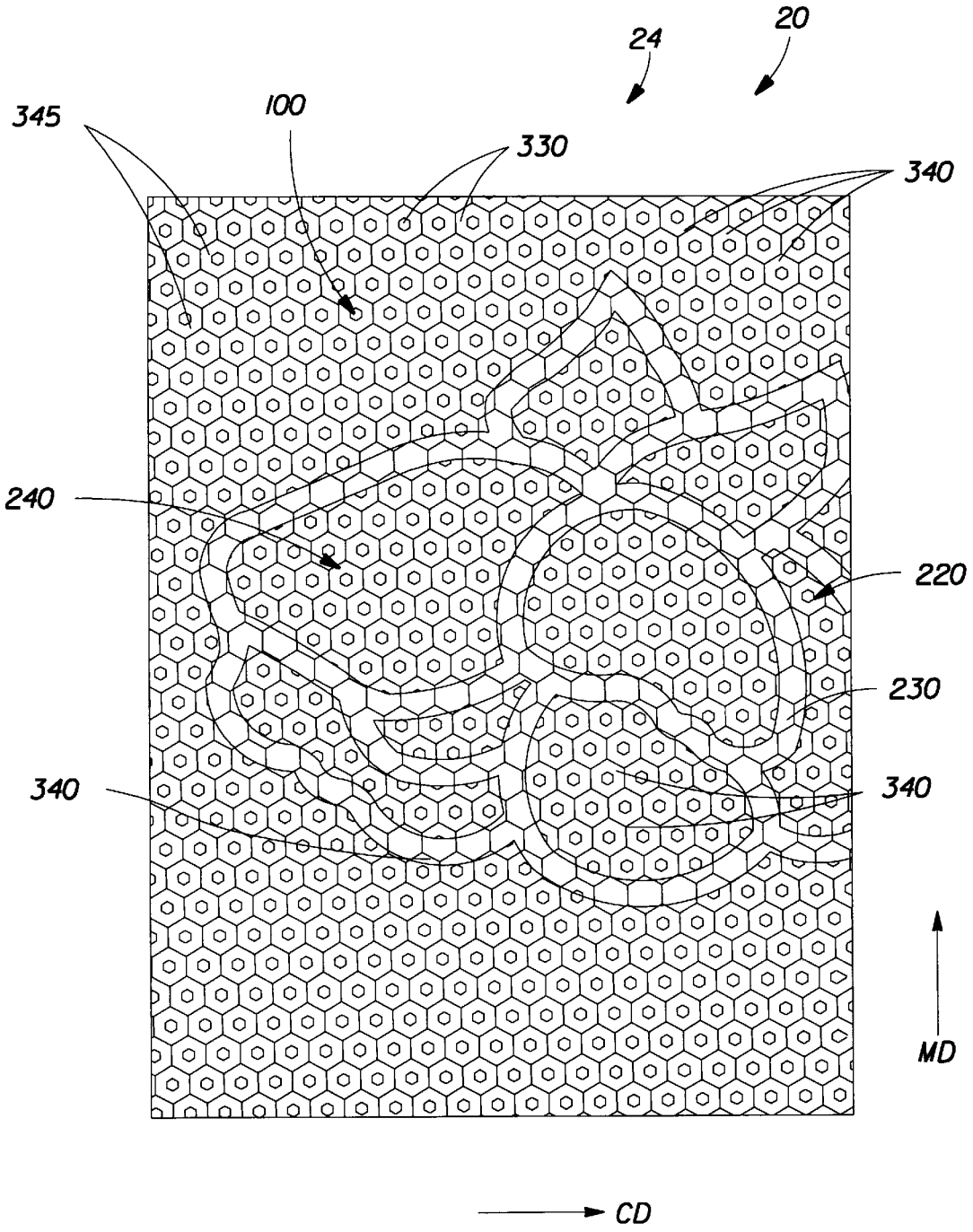
FIG. 7 is a schematic illustration of the paper web shown in FIG. 6.

FIGS. 6 and 7 depict the surface 24 of a paper structure 20 of the type shown in FIG. 1. Referring to FIGS. 6 and 7, the structure 20 includes a continuous network, relatively high density, relatively thin region 330 and a plurality of discrete, relatively low density, relatively thick regions 340 dispersed throughout the continuous network region 330. The continuous network region 330 provides web strength, while the relatively low density regions 340 provide web bulk and absorbency.

The regions 330 and 340 are superimposed on the background 100, the high basis weight regions 230, and the cells 240. In FIGS. 6 and 7, creping ridges 345 are visible on the relatively low density regions 340. Generally, the creping frequency in the regions 340 will be lower than the creping frequency in the region 330.

Figure 8:
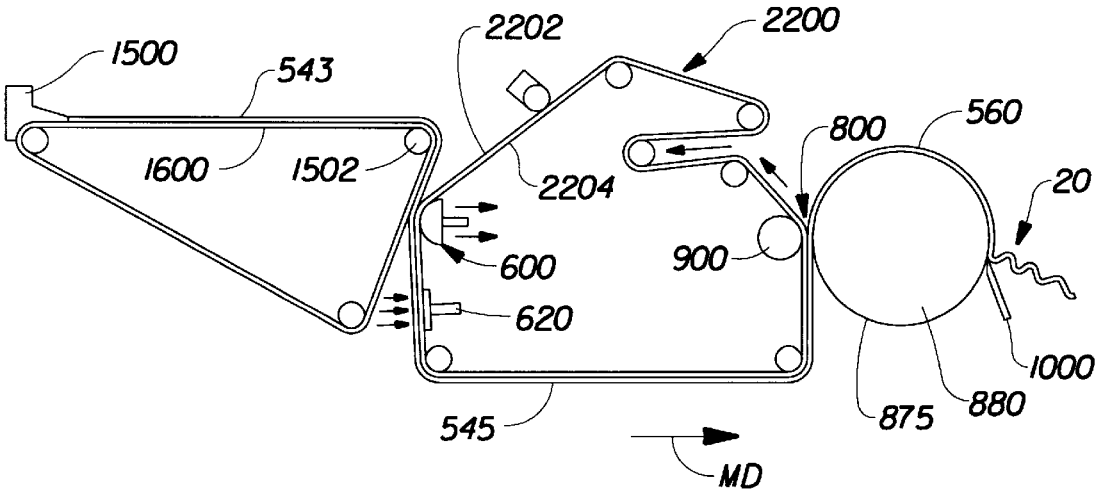
FIG. 8 is a schematic illustration of a paper machine which can be used to make a paper web of the type shown in FIGS. 1–4

A paper structure 20 according to the present invention can be made with the papermaking apparatus shown in FIG. 8. The method of making the paper structure 20 of the present invention is initiated by providing a plurality of fibers suspended in a liquid carrier, such as an aqueous dispersion of papermaking fibers in the form of a slurry, and depositing the slurry of papermaking fibers from a headbox 1500 onto a fiber retentive forming element 1600. The forming element 1600 is in the form of a continuous belt in FIG. 8.

The slurry of papermaking fibers is deposited on the forming element 1600, and water is drained from the slurry through the forming element 1600 to form an embryonic web of papermaking fibers 543 supported by the forming element 1600. The slurry of papermaking fibers can include relatively long fibers having an average fiber length of greater than or equal to 2.0 mm, and relatively short fibers having an average fiber length of less than 2.0 mm. For instance, the relatively long fibers can comprise softwood fibers, and the relatively short fibers can comprise hardwood fibers.

Figure 9:
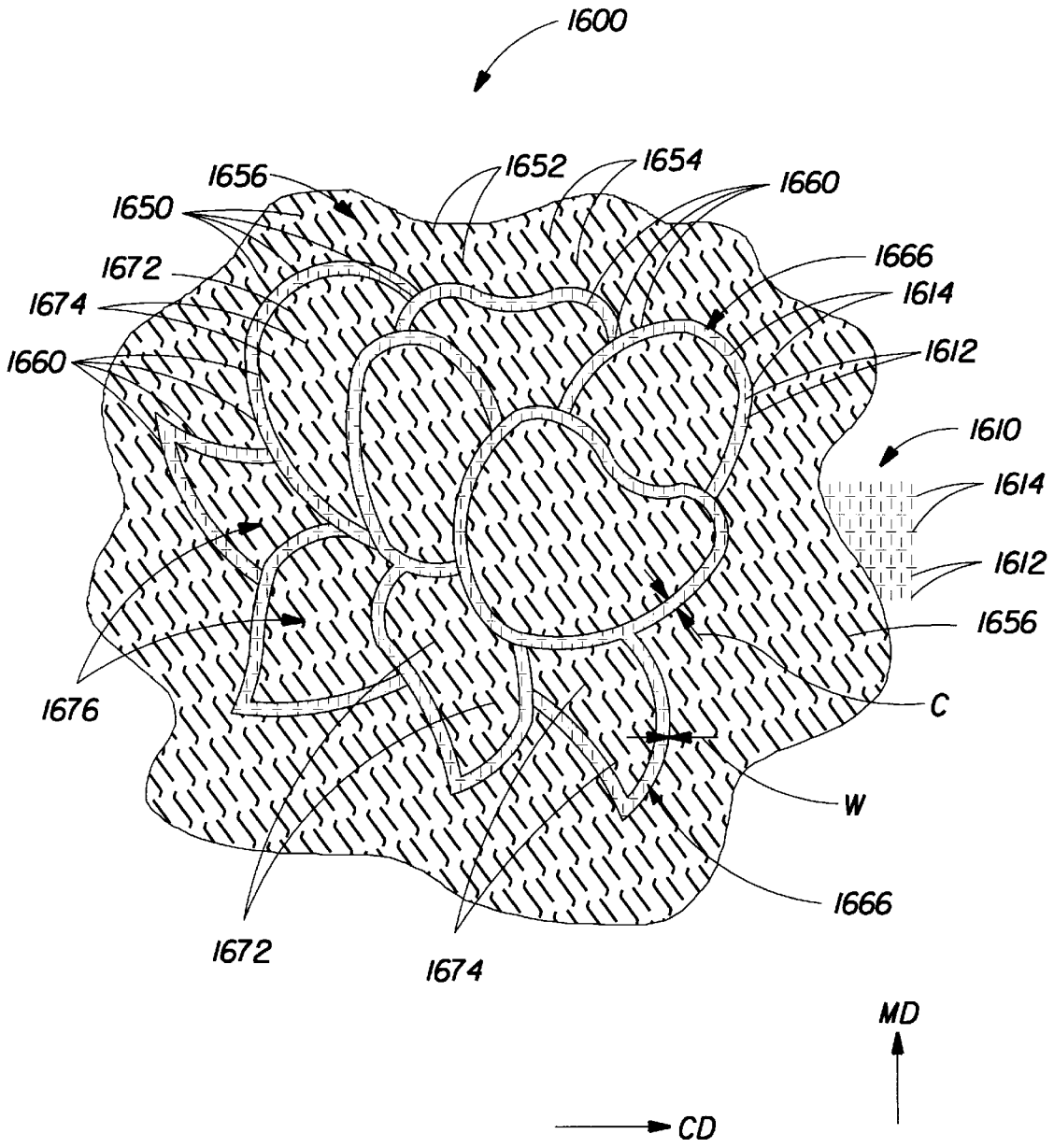
FIG. 9 is a schematic illustration of the sheet side of a forming element which can be used to make a paper web of the type shown in FIGS. 1–4.
Figure 10:
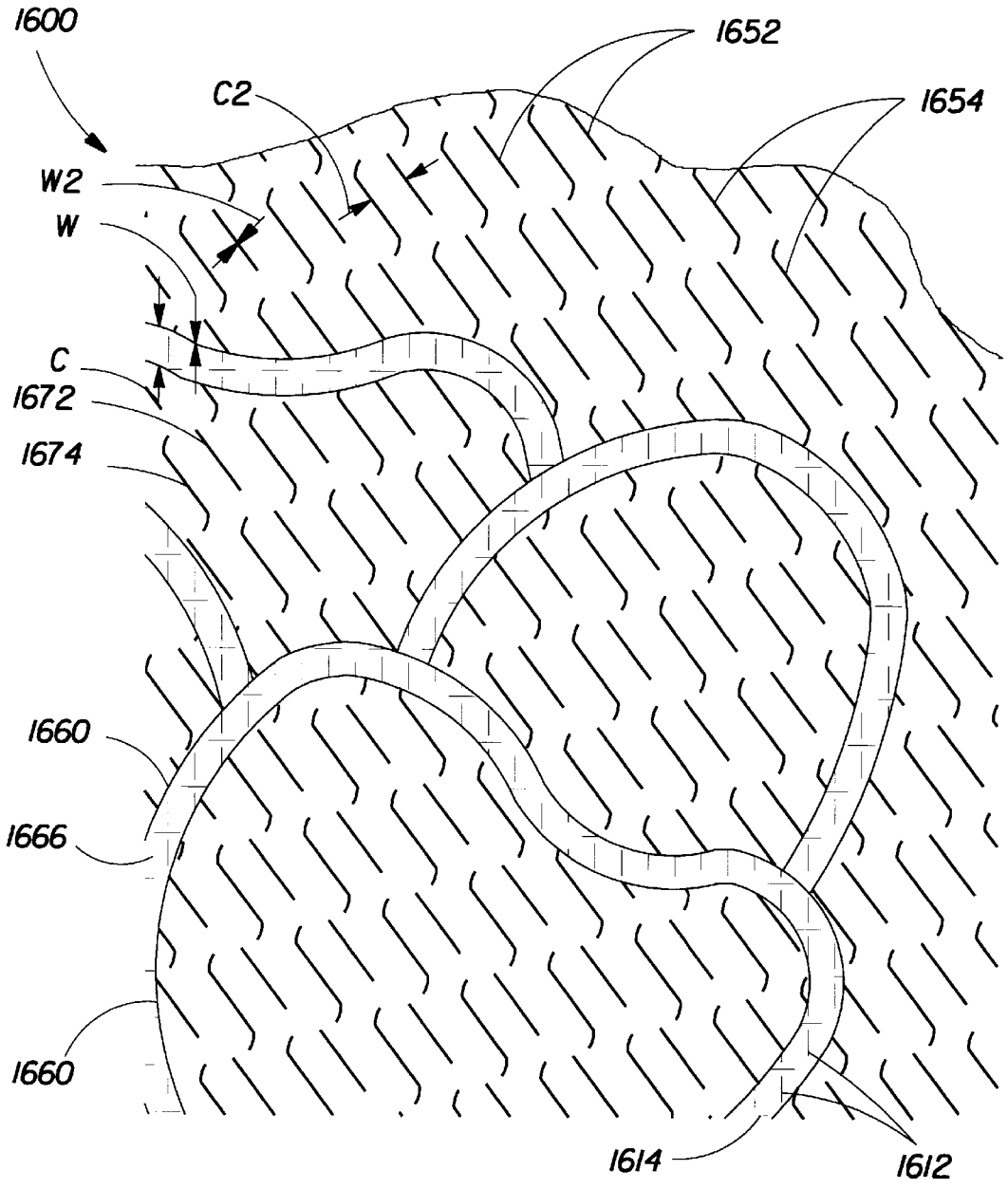
FIG. 10 is schematic illustration showing an enlarged portion of the forming element depicted in FIG. 9.
Figure 11:
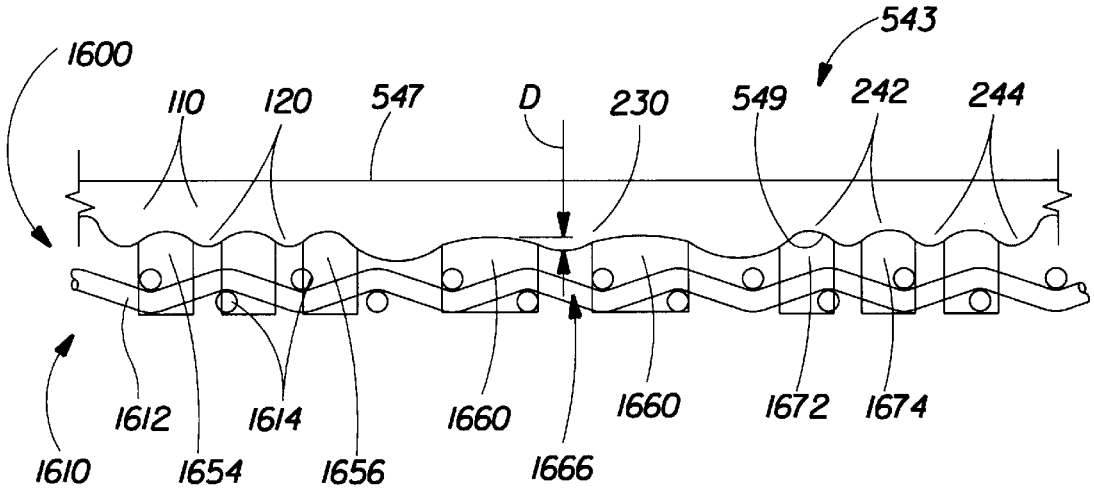
FIG. 11 is a cross-sectional illustration showing a web supported on the forming element of the type shown in FIG. 9.

FIG. 9 is schematic illustration of web or sheet facing side of a forming element 1600 suitable for making a paper web 20 according to the present invention. FIG. 10 is a schematic illustration showing an enlarged portion of the forming element depicted in FIG. 9. FIG. 11 is a cross-sectional illustration of a forming element 1600 showing the embryonic web 543 deposited on the web facing side of the forming element 1600.

The forming element 1600 comprises a liquid permeable woven base 1610 and flow restriction members 1650 disposed on the woven base 1610. The woven base 1610 comprises machine direction filaments 1612 and cross-machine direction filaments 1614. The flow restriction members 1650 can be formed by a patterned layer cast or otherwise joined to the woven base 1610.

In FIG. 9, the flow restriction members 1650 include discrete background flow restriction members 1652 and 1654, which together with the woven base 1610 provide a first drainage zone 1656 corresponding to the background 100 in FIGS. 3–4.

In FIG. 9, the flow restriction members 1650 also include decorative border flow restriction members 1660. The decorative border flow restriction members 1660 are grouped to provide discrete, decorative patterns corresponding to the decorative indicia 220. The decorative border flow restriction members 1660, together with the woven base 1610, provide a second drainage zone 1666 corresponding to the high basis weight regions 230 in FIG. 3–4.

In FIG. 9, the flow restriction members 1650 also include cell flow restriction members 1672 and 1674 which together with the woven base 1610 provide a third drainage zone 1676 corresponding to the cells 240 in FIGS. 3–4.

The liquid carrier (e.g. water) is drained through the forming element 1600 in simultaneous stages corresponding to the drainage zones 1656, 1666, and 1676. The drainage rate in the drainage zones 1666 is relatively higher than the drainage rates in the drainage zones 1656 and 1676, with fibers in the aqueous slurry tending to accumulate in the drainage zone 1666, thereby forming the relatively high basis weight regions 230 in FIG. 3 and 4.

The relatively shorter fibers tend to accumulate in the drainage zones 1666. As a result, it is believed that the average fiber length of the papermaking fibers in the relatively high basis weight regions 230 of the decorative indicia 220 is smaller than the average fiber length of the papermaking fibers in surrounding portions of the web, such as in the background 100 and in the cells 240.

The flow restriction members 1650 can be formed on the woven base by selectively curing a photopolymeric resin on the woven base 1610. Such flow restriction members 1650 are generally liquid impermeable, such that second drainage zone has a second drainage rate which is substantially zero. A suitable fiber retentive forming element 1600 can be formed with a photopolymeric resin as disclosed generally in U.S. Pat. No. 5,503,715 issued Apr. 2, 1996 in the name of Trokhan et al. and U.S. Pat. No. 5,534,326 issued Jul. 9, 1996 in the name of Trokhan et al, which patents are incorporated herein by reference.

The segments 1660 have a minimum width W measured generally perpendicular to the segment's length. If the web is formed of a single type of fiber, then the width W is preferably less than about half, and more preferably less than about one fourth of the average fiber length of the fibers. If the web is formed as a homogeneous mixture of different fiber types including hardwood and softwood fibers, the segments 1660 have a width W which is preferably less about half, and most preferably less than about one fourth of the average fiber length of the hardwood fibers forming the web. On the other hand, if the web comprises two or more layers, the width W should be less than about ½, and more preferably less than about ¼ the average fiber length of the fibers, preferably hardwood fibers, in the layer adjacent to the forming element 1600.

For instance, for a furnish made up of 100 percent Eucalyptus fibers, the width W should be less than about 0.5 millimeter, based on an average fiber length of about 1.0 mm. Alternatively, if the furnish is made up of 100 percent Northern Softwood Kraft fibers having an average fiber length of about 3.0 mm, then the width W should be less than about 1.5 mm. In one embodiment, the width W can be less than or equal to about 0.38 mm (less than or equal to about 0.015 inch).

The segments 1660 can be spaced to provide a channel width C (FIG. 9 and 10) of between about 1.0 mm and about 3.0 mm, and in one embodiment about 2.0 mm. The members 1652 and 1654 can have a width W2 substantially equal to the width W, and a spacing C2 which is less than C, and which is between about 0.4 mm and about 0.8 mm. The members 1672 and 1674 can have sizes and shapes substantially the same as those of member 1652 and 1654.

The resulting decorative indicia can each comprise high basis weight regions 230 having a substantially closed path shape which substantially encircles at least one cell 240. The width of the high basis weight regions 230 (corresponding to the channel width C) as measured at any point along the closed path shape is between about 1.0 millimeter and about 3.0 millimeter, and in one embodiment is about 2.0 millimeter.

It is anticipated that wood pulp in all its varieties will normally comprise the paper making fibers used in this invention. However, other cellulose fibrous pulps, such as cotton liners, bagasse, rayon, etc., can be used. Wood pulps useful herein include chemical pulps such as Kraft, sulfite and sulfate pulps as well as mechanical pulps including for example, ground wood, thermomechanical pulps and Chemi-ThermoMechanical Pulp (CTMP). Pulps derived from both deciduous and coniferous trees can be used. Alternatively, other non cellulosic fibers, such as synthetic fibers, can be used.

Both hardwood pulps and softwood pulps, either separately or together may be employed. The hardwood and softwood fibers can be blended, or alternatively, can be deposited in layers to provide a stratified web. U.S. Pat. No. 4,300,981 issued Nov. 17, 1981 to Carstens and U.S. Pat. No. 3,994,771 issued Nov. 30, 1976 to Morgan et al. are incorporated herein by reference for the purpose of disclosing layering of hardwood and softwood fibers.

The paper furnish can comprise a variety of additives, including but not limited to fiber binder materials, such as wet strength binder materials, dry strength binder materials, and chemical softening compositions. Suitable wet strength binders include, but are not limited to, materials such as polyamide-epichlorohydrin resins sold under the trade name of KYMENE® 557H by Hercules Inc., Wilmington, Del. Suitable temporary wet strength binders include but are not limited to synthetic polyacrylates. A suitable temporary wet strength binder is PAREZ® 750 marketed by American Cyanamid of Stanford, Conn.

Suitable dry strength binders include materials such as carboxymethyl cellulose and cationic polymers such as ACCO® 711. The CYPRO/ACCO family of dry strength materials are available from CYTEC of Kalamazoo, Mich.

The paper furnish deposited on the forming element 1600 can comprise a debonding agent to inhibit formation of some fiber to fiber bonds as the web is dried. The debonding agent, in combination with the energy provided to the web by the dry creping process, results in a portion of the web being debulked. In one embodiment, the debonding agent can be applied to fibers forming an intermediate fiber layer positioned between two or more layers. The intermediate layer acts as a debonding layer between outer layers of fibers. The creping energy can therefore debulk a portion of the web along the debonding layer.

Suitable debonding agents include chemical softening compositions such as those disclosed in U.S. Pat. No. 5,279,767 issued Jan. 18, 1994 to Phan et al. Suitable biodegradable chemical softening compositions are disclosed in U.S. Pat. No. 5,312,522 issued May 17, 1994 to Phan et al. U.S. Pat. Nos. 5,279,767 and 5,312,522 are incorporated herein by reference. Such chemical softening compositions can be used as debonding agents for inhibiting fiber to fiber bonding in one or more layers of the fibers making up the web.

One suitable softener for providing debonding of fibers in one or more layers of fibers forming the web 20 is a papermaking additive comprising DiEster Di(Touch Hardened) Tallow Dimethyl Ammonium Chloride. A suitable softener is ADOGEN® brand papermaking additive available from Witco Company of Greenwich, Conn.

The embryonic web 543 is preferably prepared from an aqueous dispersion of papermaking fibers, though dispersions in liquids other than water can be used. The fibers are dispersed in the carrier liquid to have a consistency of from about 0.1 to about 0.3 percent. Alternatively, and without being limited by theory, it believed that the present invention is applicable to moist forming operations where the fibers are dispersed in a carrier liquid to have a consistency less than about 50 percent. In yet another alternative embodiment, and without being limited by theory, it is believed that the present invention is also applicable to airlaid structures, including airlaid webs comprising pulp fibers, synthetic fibers, and mixtures thereof The percent consistency of a dispersion, slurry, web, or other system is defined as 100 times the quotient obtained when the weight of dry fiber in the system under consideration is divided by the total weight of the system. Fiber weight is always expressed on the basis of bone dry fibers.

The embryonic web 543 can be formed in a continuous papermaking process, as shown in FIG. 8, or alternatively, a batch process, such as a handsheet making process can be used. After the dispersion of papermaking fibers is deposited onto the forming element 1600, the embryonic web 543 is formed by removal of a portion of the aqueous dispersing medium through the forming element 1600 by techniques well known to those skilled in the art. Vacuum boxes, forming boards, hydrofoils, and the like are useful in effecting water removal from the aqueous dispersion of papermaking fibers to form embryonic web 543.

FIG. 11 shows an embryonic web being formed on the forming element 1600. The difference in elevation D between the top surface of the flow restriction members and the woven base 1610 is preferably less than about 6 mils (0.006 inch; 0.152 millimeter) in order to provide an generally monoplanar embryonic web 543 having substantially monoplanar first and second surfaces 547 and 549. More preferably, the difference in elevation D is less than about 3 mils. Preferably, the elevation D is preferably less than about ⅙ the average fiber length of the fibers in the web, and most preferably less than about ⅙ the average fiber length of the hardwood fibers in the web.

The embryonic web 543 travels with the forming element 1600 about a return roll 1502 and is brought into the proximity of the web support apparatus 2200. The next step in making the paper web 20 comprises transferring the embryonic web 543 from the forming element 1600 to a support apparatus 2200 having a first side 2202 and a second side 2204. The transferred web (designated by numeral 545 in FIG. 8) is supported on the first side 2202 of the apparatus 2200. The embryonic web preferably has a consistency of between about 5 and about 20 percent at the point of transfer to the web support apparatus 2200.

In one embodiment suitable for making the paper web 20 of the type shown in FIGS. 1–4, the web support apparatus 2200 can comprise a papermakers dewatering felt. By way of example, a suitable dewatering felt is an AMFLEX 2 press felt manufactured by Appleton Mills of Appleton, Wis.

The dewatering felt can have a stacked double woven base with multifilament MD yarn and cabled monofilament CD yarn, a woven base weight of about 2.3 ounce per square foot, and a stratified batt construction (3 denier over 15 denier) having a weight of 2.2 ounce per square foot. The dewatering felt can have an air permeability of about 22 scfm. The resulting web can have a generally uniform density. Alternatively, the web support apparatus 2200 can be constructed to impart a predetermined pattern of densification to the web.

The web support apparatus 20 may be made according to any of commonly assigned U.S. Pat. No. 4,514,345, issued Apr. 30, 1985 to Johnson et al.; U.S. Pat. No. 4,528,239, issued Jul. 9, 1985 to Trokhan; U.S. Pat. No. 5,098,522, issued Mar. 24, 1992; 5,260,171, issued Nov. 9, 1993 to Smurkoski et al.; U.S. Pat. No. 5,275,700, issued Jan. 4, 1994 to Trokhan; U.S. Pat. No. 5,328,565, issued Jul. 12, 1994 to Rasch et al.; 5,334,289, issued Aug. 2, 1994 to Trokhan et al.; U.S. Pat. No. 5,431,786, issued Jul. 11, 1995 to Rasch et al.; U.S. Pat. No. 5,496,624, issued Mar. 5, 1996 to Stelljes, Jr. et al.; U.S. Pat. No. 5,500,277, issued Mar. 19, 1996 to Trokhan et al.; U.S. Pat. No. 5,514,523, issued May 7, 1996 to Trokhan et al.; U.S. Pat. No. 5,554,467, issued Sep. 10, 1996, to Trokhan et al.; U.S. Pat. No. 5,566,724, issued Oct. 22, 1996 to Trokhan et al.; U.S. Pat. No. 5,624,790, issued Apr. 29, 1997 to Trokhan et al.; U.S. Pat. No. 5,628,876, issued May 13, 1997 to Ayers et al.; U.S. Pat. No. 3,301,746, issued Jan. 31, 1967 to Sanford et al.; U.S. Pat. No. 3,905,863, issued Sep. 16, 1975 to Ayers; U.S. Pat. No. 3,974,025, issued Aug. 10, 1976 to Ayers; U.S. Pat. No. 4,191,609, issued Mar. 4, 1980 to Trokhan; U.S. Pat. No. 4,239,065, issued Dec. 16, 1980 to Trokhan; U.S. Pat. No. 5,366,785 issued Nov. 22, 1994 to Sawdai; and U.S. Pat. No. 5,520,778, issued May 28, 1996 to Sawdai, the disclosures of which are incorporated herein by reference.

Figure 12:
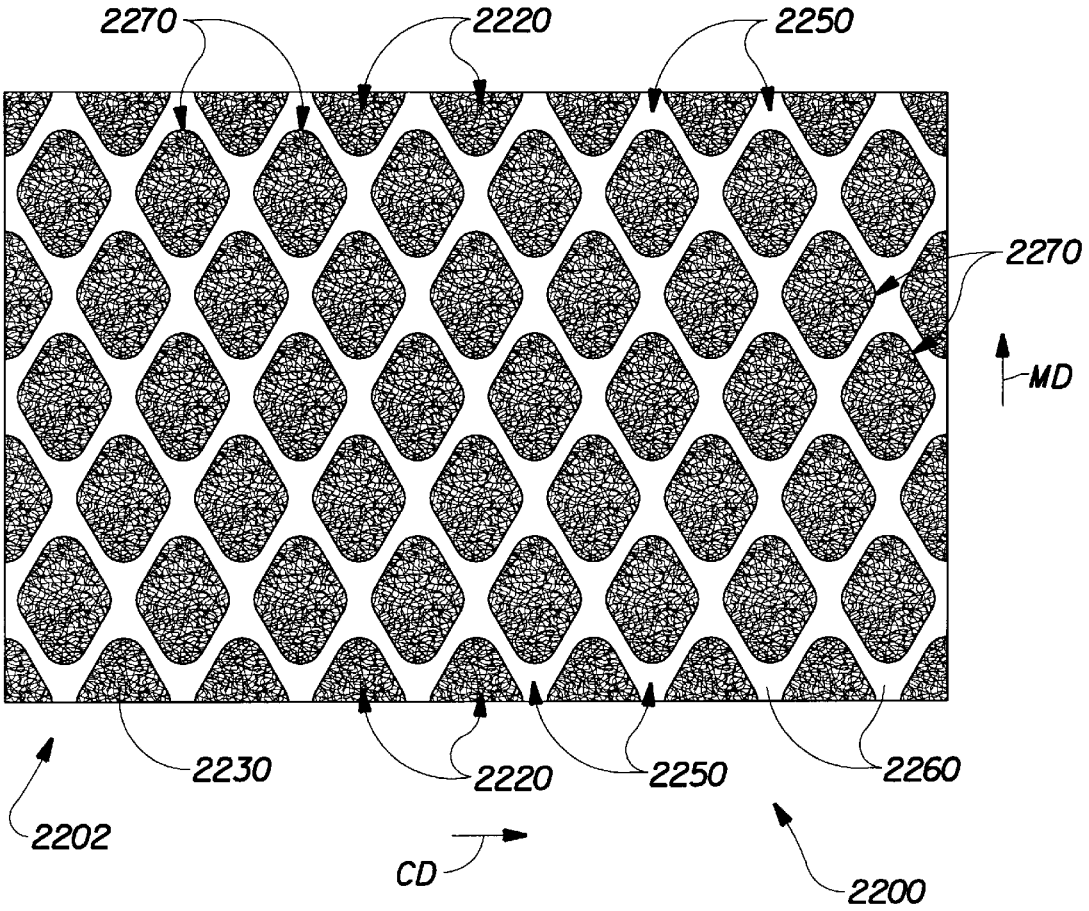
FIG. 12 is a plan view illustration showing the sheet side surface of a web support apparatus in the form of an imprinting fabric comprising a felt layer and a patterned photopolymer layer joined to the felt layer to provide a continuous network web imprinting surface.
Figure 13:
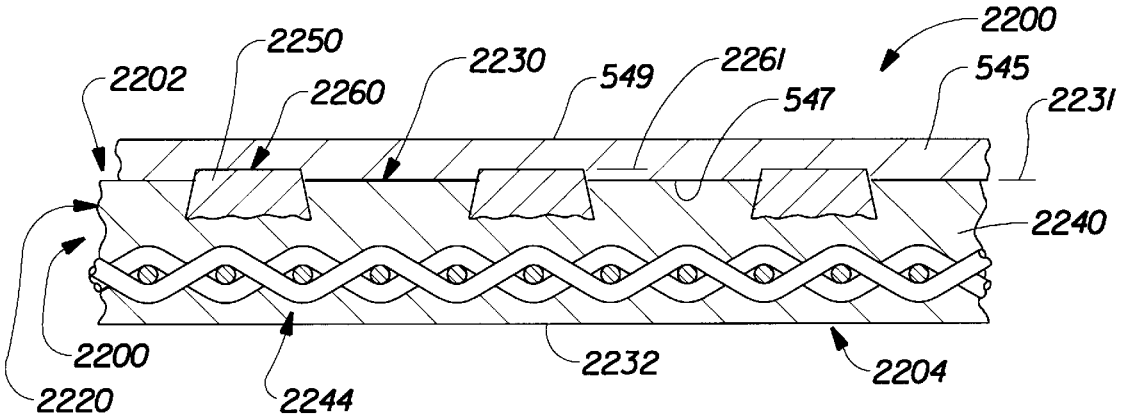
FIG. 13 is a cross-sectional schematic illustration showing the paper web transferred to the web support apparatus of the type shown in FIG. 9 to provide a paper web having a first surface conformed to the apparatus and a second substantially monoplanar surface

FIGS. 12 and 13 illustrate a particular web support apparatus 2200 which can be used to impart a predetermined pattern of densification to the web. Referring to FIGS. 12 and 13, the web support apparatus 2200 comprises a dewatering felt layer 2220 and a web patterning layer 2250. The web support apparatus 2200 can be in the form of a continuous belt for drying and imparting a pattern to a paper web on a paper machine. The web support apparatus 2200 has a first web facing side 2202 and a second oppositely facing side 2204. The web support apparatus 2200 is viewed with the first web facing side 2202 toward the viewer in FIG. 12. The first web facing side 2202 comprises a first web contacting surface and a second web contacting surface.

In FIGS. 12 and 13, the first web contacting surface is a first felt surface 2230 of the felt layer 2220. The first felt surface 2230 is disposed at a first elevation 2231. The first felt surface 2230 is a web contacting felt surface. The felt layer 2220 also has an oppositely facing second felt surface 2232.

In FIGS. 12 and 13, the second web contacting surface is provided by the web patterning layer 2250. The web patterning layer 2250, which is joined to the felt layer 2220, has a web contacting top surface 2260 at a second elevation 2261. The difference between the first elevation 2231 and the second elevation 2261 is less than the thickness of the paper web when the paper web is transferred to the web support apparatus 2200. The surfaces 2260 and 2230 can be disposed at the same elevation, so that the elevations 2231 and 2261 are the same. Alternatively, surface 2260 can be slightly above surface 2230, or surface 2230 can be slightly above surface 2260.

The difference in elevation is greater than or equal to 0.0 mils and less than about 8.0 mils. In one embodiment, the difference in elevation is less than about 6.0 mils (0.15 mm), more preferably less than about 4.0 mils (0.10 mm), and most preferably less than about 2.0 mil (0.05 mm), in order to maintain a relatively smooth surface 24 of the web 20.

The dewatering felt layer 2220 is water permeable and is capable of receiving and containing water pressed from a wet web of papermaking fibers. The web patterning layer 2250 is water impervious, and does not receive or contain water pressed from a web of papermaking fibers. The web patterning layer 2250 can have a continuous web contacting top surface 2260, as shown in FIG. 12. Alternatively, the web patterning layer can be discontinuous or semicontinuous.

The web patterning layer 2250 preferably comprises a photosensitive resin which can be deposited on the first surface 2230 as a liquid and subsequently cured by radiation so that a portion of the web patterning layer 2250 penetrates, and is thereby securely bonded to, the first felt surface 2230. The web patterning layer 2250 preferably does not extend through the entire thickness of the felt layer 2220, but instead extends through less than about half the thickness of the felt layer 2220 to maintain the flexibility and compressibility of the web support apparatus 2200, and particularly the flexibility and compressibility of the felt layer 2220.

A suitable dewatering felt layer 2220 comprises a nonwoven batt 2240 of natural or synthetic fibers joined, such as by needling, to a support structure formed of woven filaments 2244 (FIG. 13). Suitable materials from which the nonwoven batt can be formed include but are not limited to natural fibers such as wool and synthetic fibers such as polyester and nylon. The fibers from which the batt 2240 is formed can have a denier of between about 3 and about 20 grams per 9000 meters of filament length.

The felt layer 2220 can have a layered construction, and can comprise a mixture of fiber types and sizes. The felt layer 2220 is formed to promote transport of water received from the web away from the first felt surface 2230 and toward the second felt surface 2232. The felt layer 2220 can have finer, relatively densely packed fibers disposed adjacent the first felt surface 2230. The felt layer 2220 preferably has a relatively high density and relatively small pore size adjacent the first felt surface 2230 as compared to the density and pore size of the felt layer 2220 adjacent the second felt surface 2232, such that water entering the first surface 2230 is carried away from the first surface 2230.

The dewatering felt layer 2220 can have a thickness greater than about 2 mm. In one embodiment the dewatering felt layer 2220 can have a thickness of between about 2 mm and about 5 mm.

PCT Publications WO 96/00812 published Jan. 11, 1996, WO 96/25555 published Aug. 22, 1996, WO 96/25547 published Aug. 22, 1996, all in the name of Trokhan et al.; U.S. patent application Ser. No. 08/701,600 "Method for Applying a Resin to a Substrate for Use in Papermaking" filed Aug. 22, 1996; U.S. Patent application Ser. No. 08/640,452 "High Absorbence/Low Reflectance Felts with a Pattern Layer" filed Apr. 30, 1996; and U.S. patent application Ser. No. 08/672,293 "Method of Making Wet Pressed Tissue Paper with Felts Having Selected Permeabilities" filed Jun. 28, 1996; U.S. Pat. No. 5,556,509 issued Sep. 17, 1996 to Trokhan et al.; U.S. Pat. No. 5,580,423, issued Dec. 3, 1996 to Ampulski et al.; U.S. Pat. No. 5,609,725, issued Mar. 11, 1997 to Phan; U.S. Pat. No. 5,629,052 issued May 13, 1997 to Trokhan et al.; U.S. Pat. No. 5,637,194, issued Jun. 10, 1997 to Ampulski et al. and U.S. Pat. No. 5,674,663, issued Oct. 7, 1997 to McFarland et al., are incorporated herein by reference for the purpose of disclosing applying a photosensitive resin to a dewatering felt or for the purpose of disclosing suitable dewatering felts.

The dewatering felt layer 2220 can have an air permeability of less than about 200 standard cubic feet per minute (scfm), where the air permeability in scfin is a measure of the number of cubic feet of air per minute that pass through a one square foot area of a felt layer, at a pressure differential across the dewatering felt thickness of about 0.5 inch of water. In one embodiment, the dewatering felt layer 2220 can have an air permeability of between about 5 and about 200 scfm, and more preferably less than about 100 scfm.

The dewatering felt layer 2220 can have a basis weight of between about 800 and about 2000 grams per square meter, an average density (basis weight divided by thickness) of between about 0.35 gram per cubic centimeter and about 0.45 gram per cubic centimeter. The air permeability of the web support apparatus 2200 is less than or equal to the permeability of the felt layer 2220.

One suitable felt layer 2220 is an Amflex 2 Press Felt manufactured by Appleton Mills of Appleton, Wis. The felt layer 2220 can have a thickness of about 3 millimeter, a basis weight of about 1400 gm/square meter, an air permeability of about 30 scfm, and have a double layer support structure having a 3 ply multifilament top and bottom warp and a 4 ply cabled monofilament cross-machine direction weave. The batt 2240 can comprise nylon fibers having a denier of about 3 at the first surface 2230, and a denier of between about 10–15 in the batt substrate underlying the first surface 2230.

The web support apparatus 2200 shown in FIG. 12 has a web patterning layer 2250 having a continuous network web contacting top surface 2260 having a plurality of discrete openings 2270 therein. Suitable shapes for the openings 2270 include, but are not limited to circles, ovals elongated in the machine direction (MD in FIG. 9), polygons, irregular shapes, or mixtures of these. The projected surface area of the continuous network top surface 2260 can be between about 5 and about 75 percent of the projected area of the web support apparatus 2200 as viewed in FIG. 9, and is preferably between about 25 percent and about 50 percent of the projected area of the apparatus 2200.

The continuous network top surface 2260 can have at least about 10,000, more preferably at least about 15,000, and even more preferably at least about 50,000 discrete openings 2270 per square meter of the projected area of the apparatus 2200 as viewed in FIG. 12. In one embodiment, the continuous network top surface 2260 has at least about 100,000 discrete openings 2270 per square meter.

The discrete openings 2270 can be bilaterally staggered in the machine direction (MD) and cross-machine direction (CD) as described in U.S. Pat. No. 4,637,859 issued Jan. 20, 1987 which patent is incorporated herein by reference. The following U.S. Patents related to photopolymer resin structures and/or drying fabrics are also incorporated herein by reference: U.S. Pat. No. 5,500,277; U.S. Pat. Nos. 5,274,930; 5,275,700; 4,514,345; and 5,098,522.

The web is transferred to the web support apparatus 2200 such that the first face 547 of the transferred web 545 is supported on and conformed to the side 2202 of the apparatus 2200, with parts of the web 545 supported on the surface 2260 and parts of the web supported on the felt surface 2230. The second face 549 of the web is maintained in a substantially macroscopically monoplanar configuration. Referring to FIG. 13, the elevation difference between the surface 2260 and the surface 2230 of the web support apparatus 2200 is sufficiently small that the second face of the web remains substantially macroscopically monoplanar when the web is transferred to the apparatus 2200. In particular, the difference in elevation between the surface 2260 and the surface 2230 can be smaller than the thickness of the embryonic web at the point of transfer.

The steps of transferring the embryonic web 543 to the apparatus 2200 can be provided, at least in part, by applying a differential fluid pressure to the embryonic web 543. The embryonic web 543 can be vacuum transferred from the forming element 1600 to the apparatus 2200 by a vacuum source 600 depicted in FIG. 8, such as a vacuum shoe or a vacuum roll. One or more additional vacuum sources 620 can also be provided downstream of the embryonic web transfer point to provide further dewatering.

Figure 14:
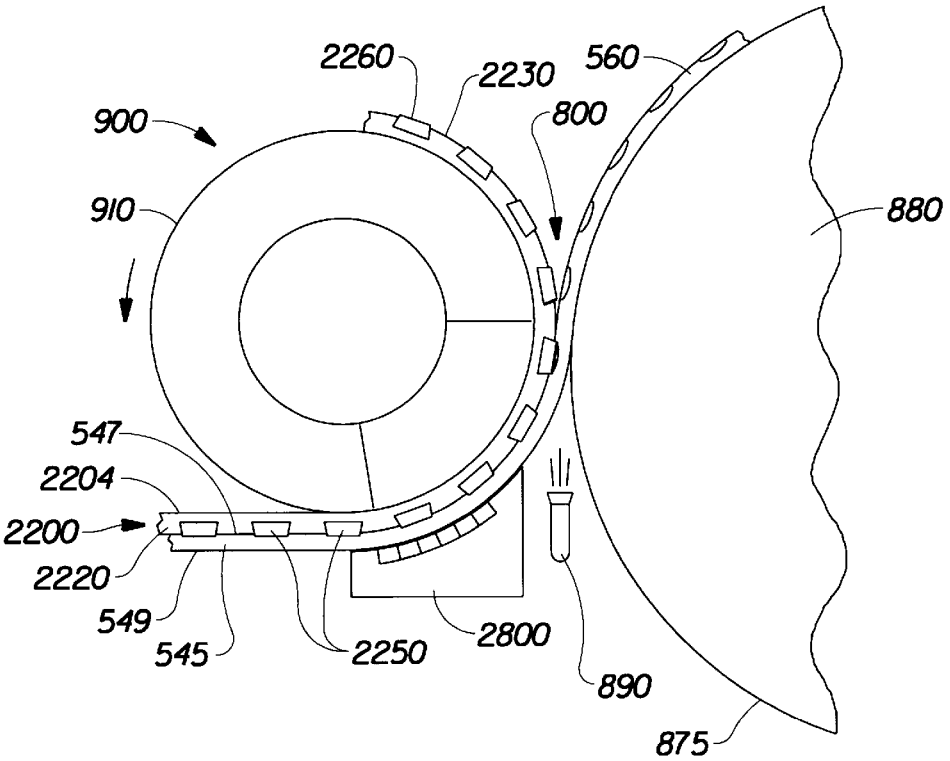
FIG. 14 is a schematic illustration showing a paper web being transferred to a Yankee dryer.

The web 545 is carried on the apparatus 2200 in the machine direction (MD in FIG. 8) to a nip 800 provided between a vacuum pressure roll 900 and a hard surface 875 of a heated Yankee dryer drum 880. Referring to FIG. 14, a steam hood 2800 can be positioned just upstream of the nip 800. The steam hood can be used to direct steam onto the surface 549 of the web 545 as the surface 547 of the web 545 is carried over the vacuum pressure roll 900.

The steam hood 2800 is mounted opposite a section of the vacuum providing portion 920 of the vacuum pressure roll. The vacuum providing portion 920 draws the steam into the web 545 and the felt layer 2220. The steam provided by steam hood 2800 heats the water in the paper web 545 and the felt layer 2220, thereby reducing the viscosity of the water in the web and the felt layer 2220. Accordingly, the water in the web and the felt layer 2220 can be more readily removed by the vacuum provided by roll 900.

The steam hood 2800 can provide about 0.3 pound of saturated steam per pound of dry fiber at a pressure of less than about 15 psi. The vacuum providing portion 920 provides a vacuum of between about 1 and about 15 inches of Mercury, and preferably between about 3 and about 12 inches of Mercury at the surface 2204.

A suitable vacuum pressure roll 900 is a suction pressure roll manufactured by Winchester Roll Products. A suitable steam hood 2800 is a model D5A manufactured by Measurex-Devron Company of North Vancouver, British Columbia, Canada.

The vacuum providing portion 920 is in communication with a source of vacuum (not shown). The vacuum providing portion 920 is stationary relative to the rotating surface 910 of the roll 900. The surface 910 can be a drilled or grooved surface through which vacuum is applied to the surface 2204. The surface 910 rotates in the direction shown in FIG. 14. The vacuum providing portion 920 provides a vacuum at the surface 2204 of the web support apparatus 2200 as the web and apparatus 2200 are carried through the steam hood 2800 and through the nip 800. While a single vacuum providing portion 920 is shown, in other embodiments it may be desirable to provide separate vacuum providing portions, each providing a different vacuum at the surface 2204 as the apparatus 2200 travel around the roll 900.

The Yankee dryer typically comprises a steam heated steel or iron drum. Referring to FIGS. 8 and 14, the web 545 is carried into the nip 800 supported on the apparatus 2200, such that the relatively smooth second face 549 of the web can be transferred to the surface 875. Upstream of the nip, prior to the point where the web is transferred to the surface 875, a nozzle 890 applies an adhesive to the surface 875.

The adhesive can be a polyvinyl alcohol based adhesive. Alternatively, the adhesive can be CREPTROL® brand adhesive manufactured by Hercules Company of Wilmington Del. Other adhesives can also be used. Generally, for embodiments where the web is transferred to the Yankee drum 880 at a consistency greater than about 45 percent, a polyvinyl alcohol based creping adhesive can be used. At consistencies lower than about 40 percent, an adhesive such as the CREPTROL® adhesive can be used.

The adhesive can be applied to the web directly, or indirectly (such as by application to the Yankee surface 875), in a number of ways. For instance, the adhesive can be sprayed in micro-droplet form onto the web, or onto the Yankee surface 875. Alternatively, the adhesive could also be applied to the surface 875 by a transfer roller or brush. In yet another embodiment, the creping adhesive could be added to the paper furnish at the wet end of the papermachine, such as by adding the adhesive to the paper furnish in the headbox 500. From about 2 pounds to about 4 pounds of adhesive can be applied per ton of paper fibers dried on the Yankee drum 880.

As the web is carried on the apparatus 2200 through the nip 800, the vacuum providing portion 920 of the roll 900 provides a vacuum at the surface 2204 of the web support apparatus 2200. Also, as the web is carried on the apparatus 2200 through the nip 800, between the vacuum pressure roll 900 and the dryer surface 800, the web patterning layer 2250 of the web support apparatus 2200 imparts the pattern corresponding to the surface 2260 to the first face 547 of the web 545.

The second face 549 is a substantially macroscopically monoplanar face, substantially all of the of the second surface 549 is positioned against, and adhered to, the dryer surface 875 as the web is carried through the nip 800. As the web is carried through the nip, the second face 549 is supported against the smooth surface 875 to be maintained in a substantially macroscopically monoplanar configuration. Accordingly, a predetermined pattern can be imparted to the first face 547 of the web 545, while the second face 549 remains substantially monoplanar.

In non-through air dried embodiments, the web 545 preferably has a consistency of between about 20 percent and about 60 percent when the web 545 is transferred to the surface 875 and the pattern of surface 2260 is imparted to the web to selectively densify the web. The pattern of the surface 2260 is imparted to the web to provide the continuous network region 330 and the discrete, relatively low density regions 340 shown in FIGS. 6 and 7.

Without being limited by theory, it is believed that, as a result of having substantially all of the second face 549 positioned against the Yankee surface 875, drying of the web 545 on the Yankee is more efficient than would be possible with a web which has only selective portions of the second face against the Yankee.

Alternatively, a Yankeeless, uncreped process can be employed. The embryonic web can be formed on a forming element, as described above, to have multiple basis weights and a visually discernible decorative pattern, but can be dried without the use of a Yankee drum or doctor blade. The web can be wet microcontracted to provide machine direction stretch, and then through air dried. European Patent Publication 0677612A2 published Oct., 18, 1995 in the name of Wendt et al. discloses a Yankeeless papermaking method, and is incorporated herein by reference.

FIGS. 15–18 illustrate a paper web 20 according to an alternative embodiment of the present invention. The paper structure in FIGS. 15–18 comprises a background portion 100 and between about 10 and about 50 discrete, decorative indicia 220 per square foot of the surface 22, as viewed in FIG. 15.

Figure 15:
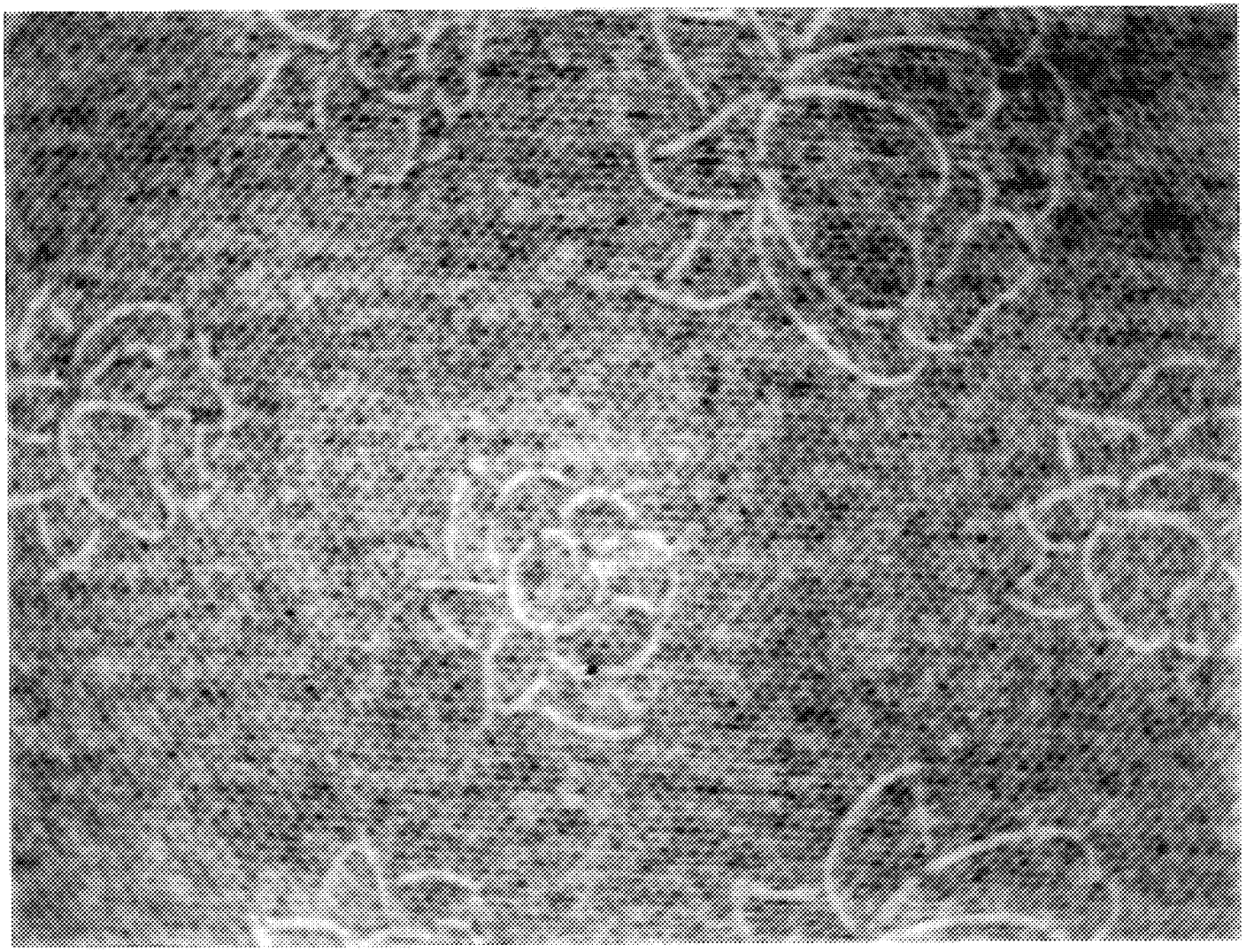
FIG. 15 is a photograph of a portion of a paper web made according to one embodiment of the present invention.
Figure 16:
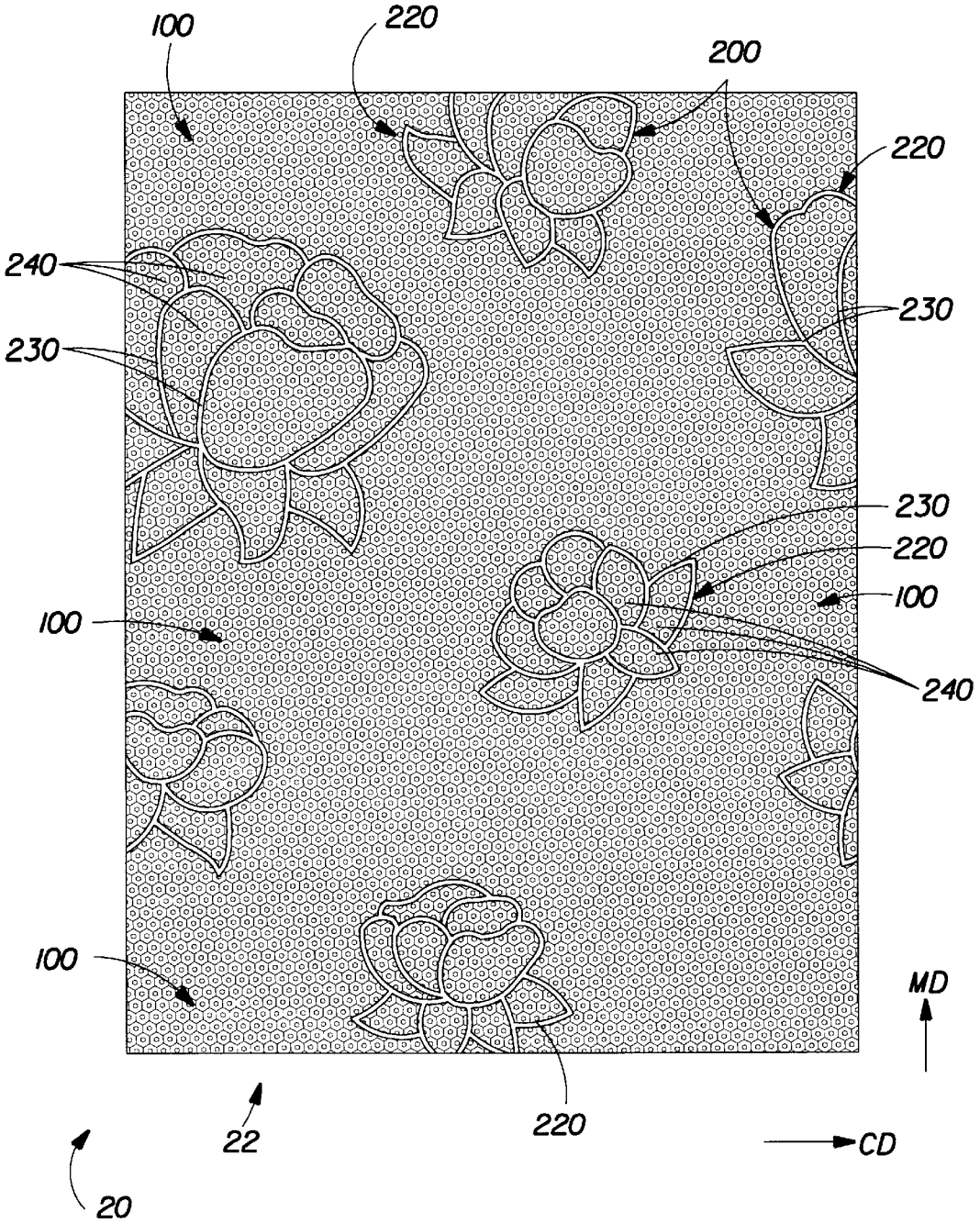
FIG. 16 is a schematic illustration of a paper web of the type shown in FIG. 10.

The background portion 100 can comprise at least 50 percent of the surface area of the first surface 22, as viewed FIG. 15. In one embodiment, the background portion 100 comprises at least 70 percent of the surface area of surface 22.

Each discrete, decorative indicia 220 is separated from adjacent decorative indicia 220 by the background portion 100. The decorative pattern 200 comprises at least one high basis weight region having a basis weight which is greater than the average basis weight of the surrounding background portion 100.

In FIGS. 15–18, each decorative indicia 220 comprises a plurality of high basis weight regions 230 which, together, form a border defining the shape of the decorative indicia 220. The high basis weight regions 230 preferably comprise less than about 30 percent, more preferably less than about 15 percent of the surface area of surface 22.

The decorative indicia 220 in FIGS. 15–18 include a plurality of cells 240 substantially enclosed by the border formed by the high basis weight regions 230. The high basis weight regions 230 can have a basis weight that is greater than the average basis weight of each cell 240. The average basis weight of each cell 240 can be substantially equal to the average basis weight of the background portion 100.

Figure 17:
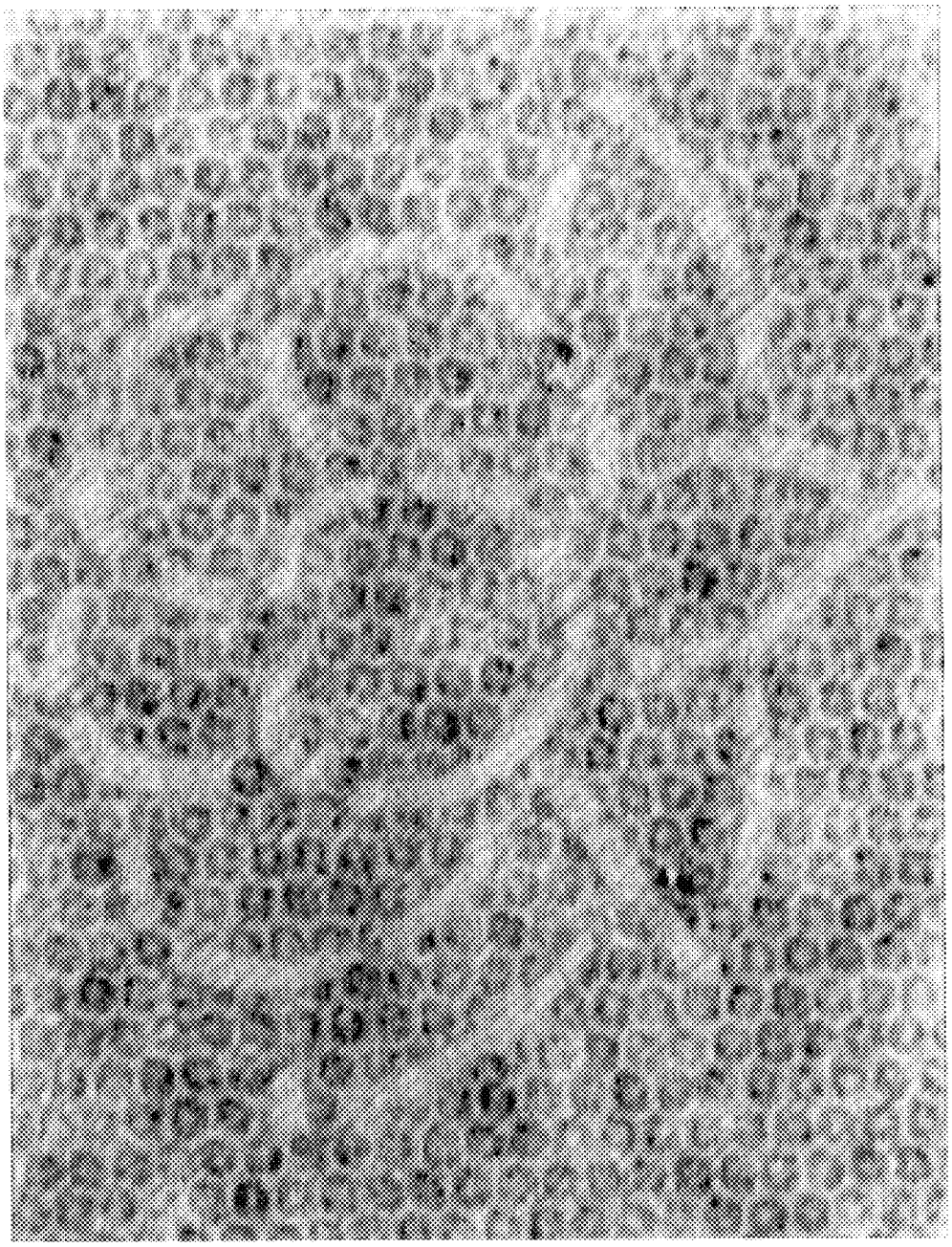
FIG. 17 is an photographic enlargement of the paper web shown in FIG. 15.
Figure 18:
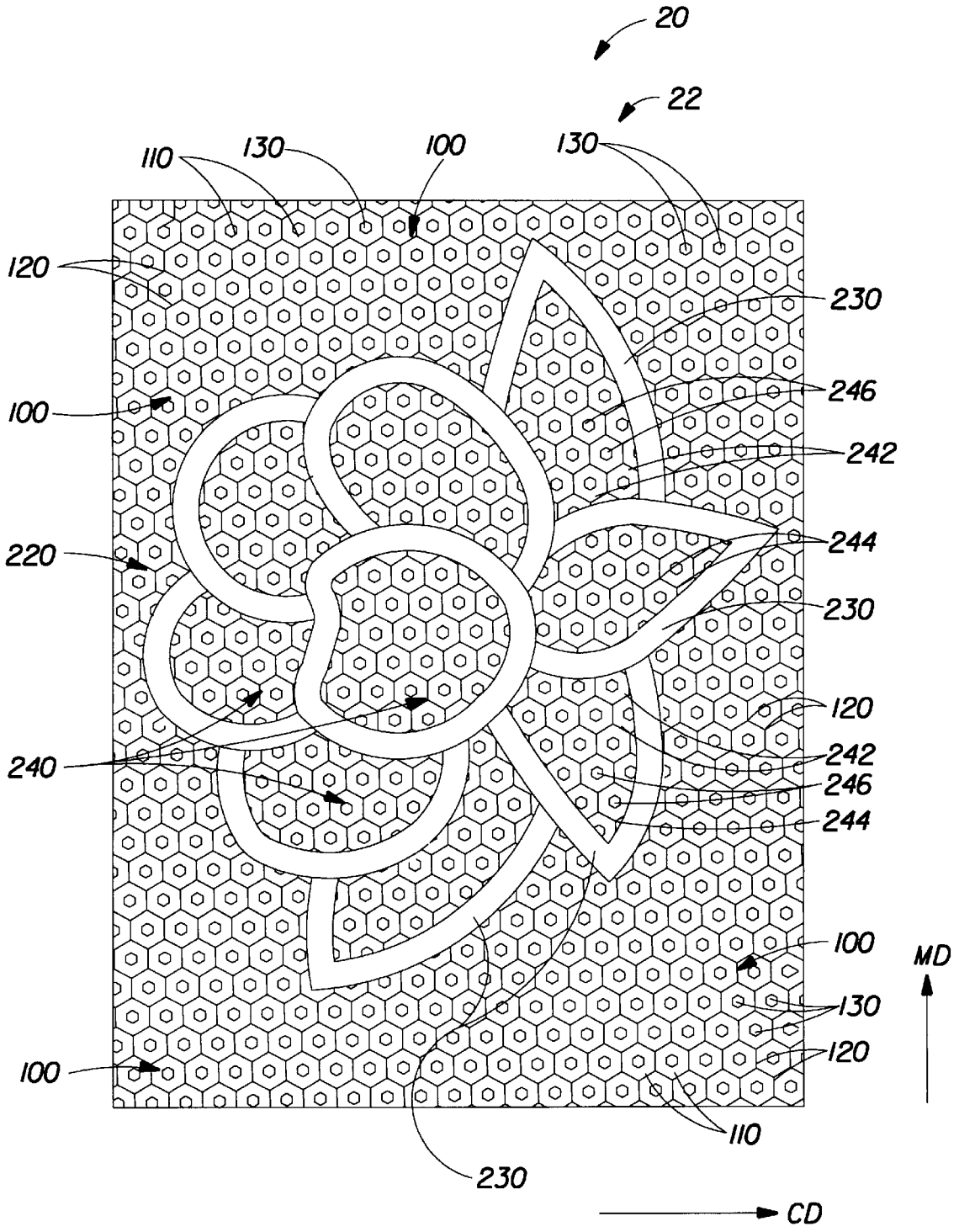
FIG. 18 is a schematic illustration of a paper web of the type shown in FIG. 17.

The paper web 20 shown in FIGS. 15–18 has a background portion 100 which comprises at least three regions disposed in a nonrandom, repeating pattern, the regions being distinguishable from each other by basis weight. Referring to FIGS. 17 and 18, the background portion 100 comprises a relatively high basis weight, continuous network region 120, a plurality of discrete, relatively lower basis weight regions 110 dispersed throughout the continuous network region 120, and a plurality of discrete regions 130, each region 130 generally encircled by a relatively lower basis weight region 110. The regions 110 are visually distinguishable from the region 120, and the basis weight of the regions 110 is less than the basis weight of the region 120. The regions 130 are visually distinguishable from the regions 110, can have a basis weight which is intermediate the basis weights of the region 120 and the regions 110.

In FIGS. 17 and 18, the cells 240 each comprise a relatively high basis weight, continuous network region 244, a plurality of discrete, relatively lower basis weight regions 242 dispersed throughout the continuous network region 244, and a plurality of discrete regions 246, each region 246 generally encircled by a relatively lower basis weigh region 242. The regions 242 and 244 are distinguishable from each other by basis weight. The basis weight of the regions 242 is less than the basis weight of the regions 244. The regions 246 can have a basis weight which is intermediate the basis weight of the region 244 and the regions 242.

Figure 19:
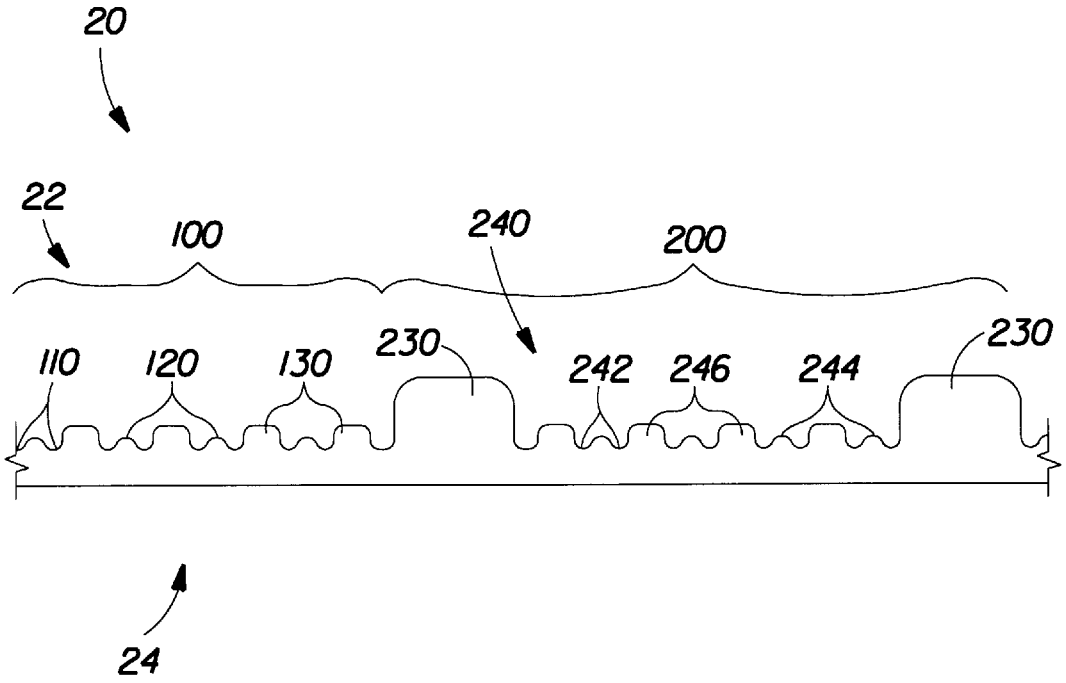
FIG. 19 is a cross-sectional schematic illustration of a paper web of the type shown in FIG. 15.

The predetermined variation of basis weight within the background 100 and the cells 240 help to make the decorative indicia 220 stand out visually, thereby helping to accentuate the decorative pattern of the paper structure FIG. 19 provides a cross-sectional illustration of the different basis weight regions of the paper structure 20 depicted in FIGS. 15–18. The basis weights of different portions of the web are indicated by thickness in FIG. 19. The background portion 100 can have an opacity of at least about 3.0. The cells 240 can have an opacity of at least about 3.0. The high basis weight regions 230 have an opacity which is greater than that of the background portion and the cells 240, and the high basis weight regions 230 preferably have an opacity which is at least about 4.0.

The difference in the opacity of the background 100 and the cells 240 as compared to that of the high basis weight regions 230 in the decorative indicia 220 help to make the decorative indicia visually discernable. Basis weight and opacity are measured as described below under Test Methods.

Figure 20:
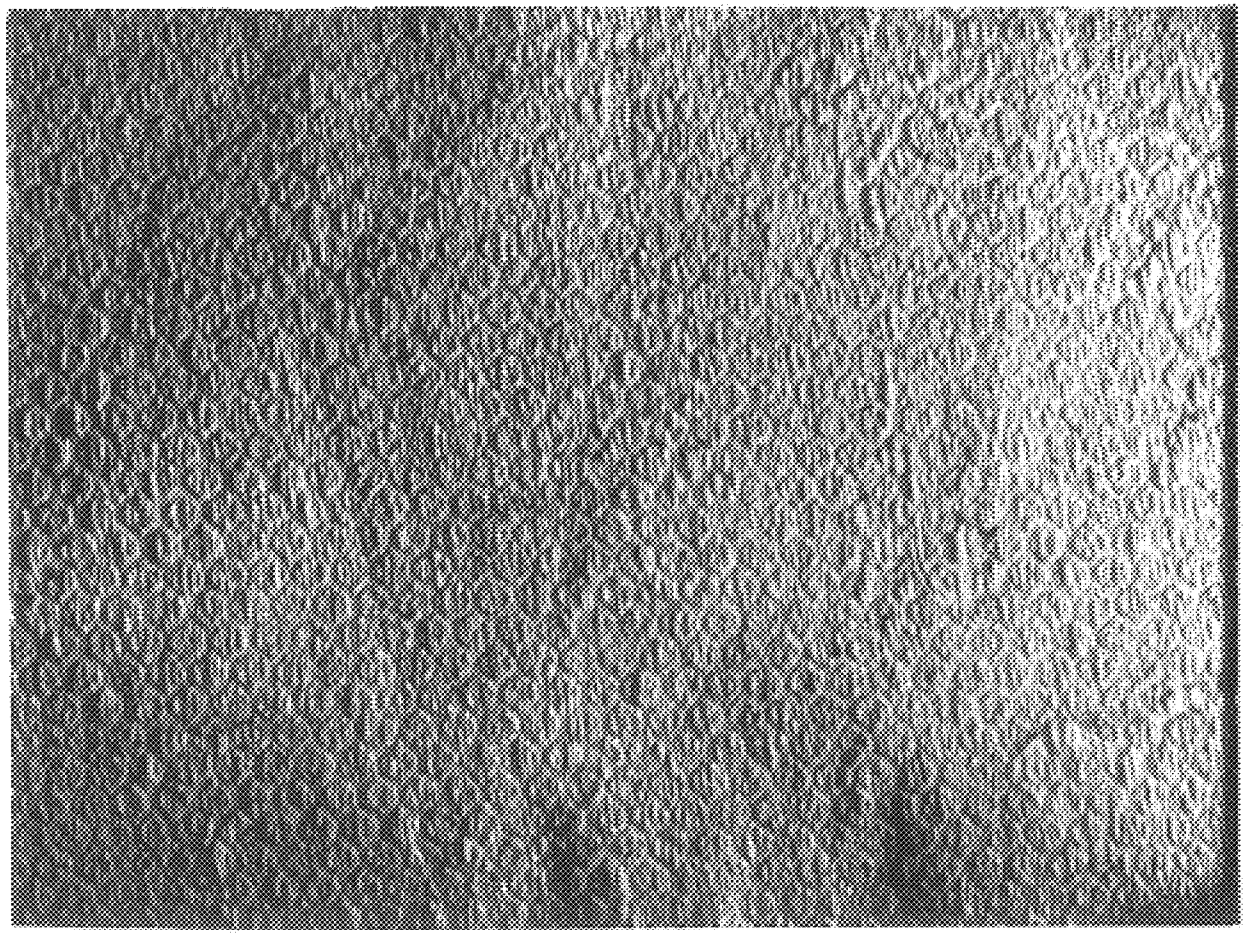
FIG. 20 is a photograph of a portion of a paper web of the type shown in FIG. 15 showing the paper web to have a continuous network region.
Figure 21:
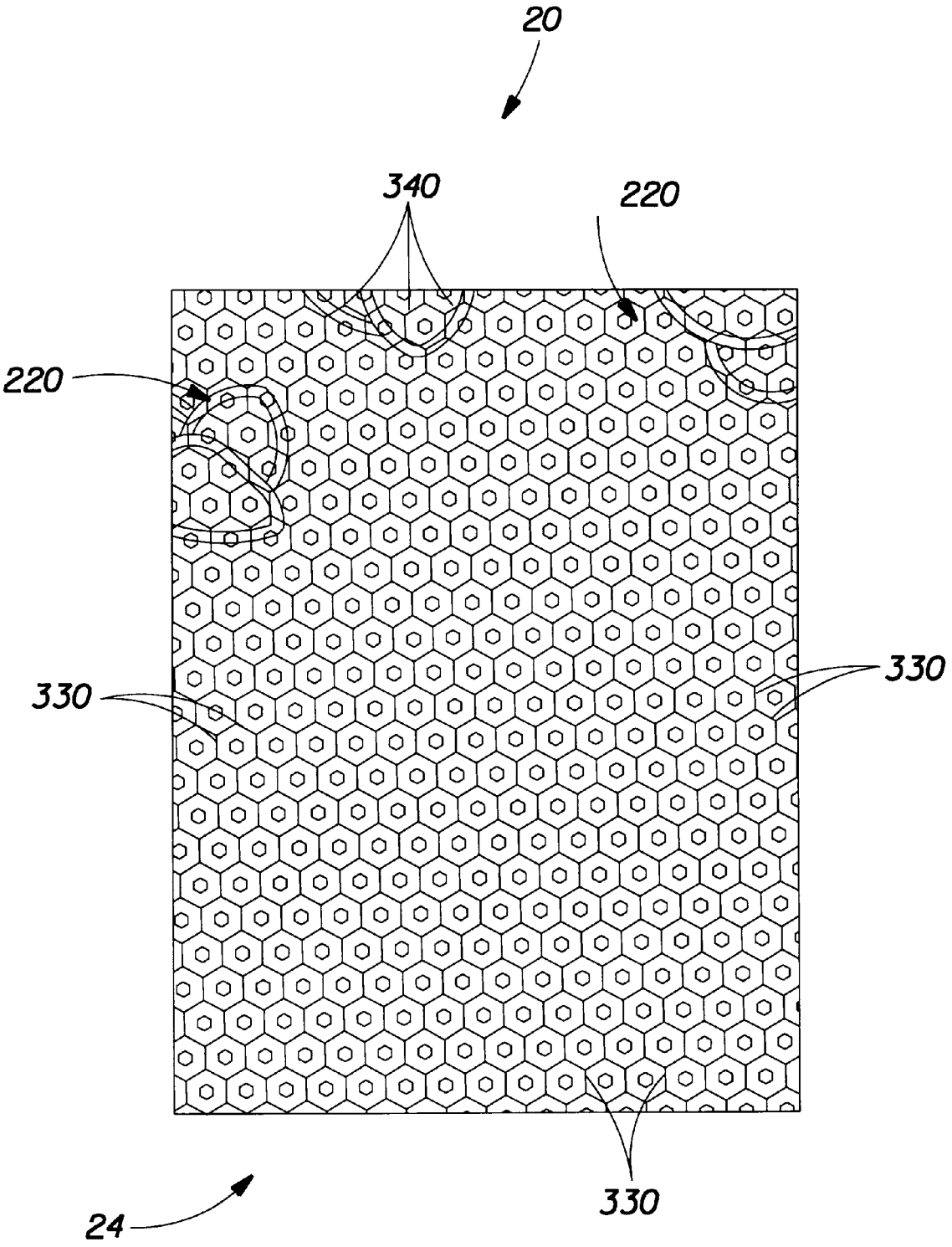
FIG. 21 is a schematic illustration of the paper web shown in FIG. 20.

FIGS. 20 and 21 depict the surface 24 of a paper structure 20 of the type shown in FIGS. 15–18. Referring to FIGS. 20 and 21, the structure 20 can include a continuous network, relatively high density region 330 and a plurality of discrete, relatively low density regions 340 dispersed throughout the continuous network region 330. The continuous network region 330 provides web strength, while the relatively low density regions 340 provide web bulk and absorbency. The regions 330 and 340 are superimposed on the background 100, the high basis weight regions 230, and the cells 240.

Figure 22:
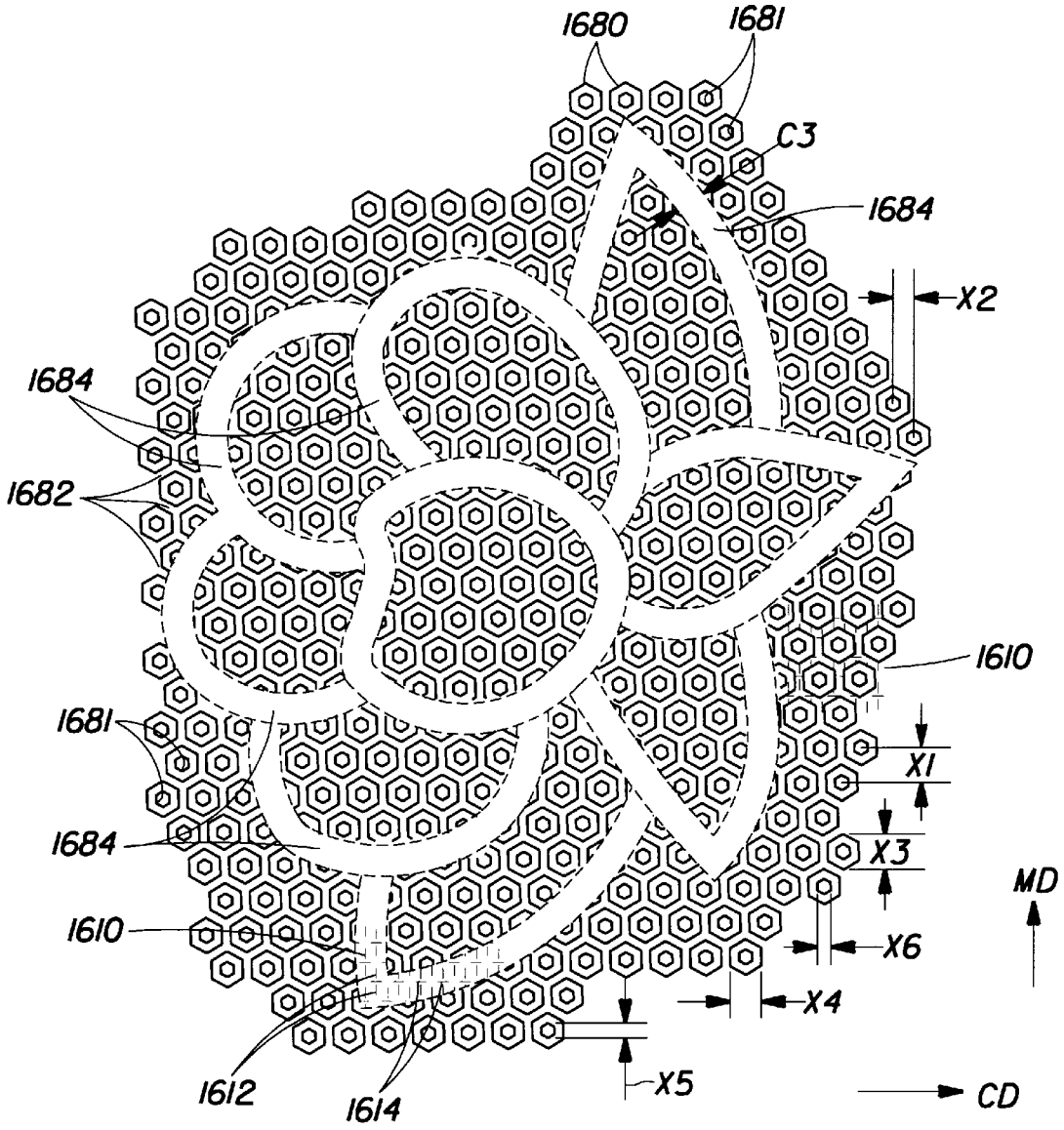
FIG. 22 is a schematic illustration of the sheet side of a forming element which can be used to make a paper web of the type shown in FIG. 15.
Figure 23:
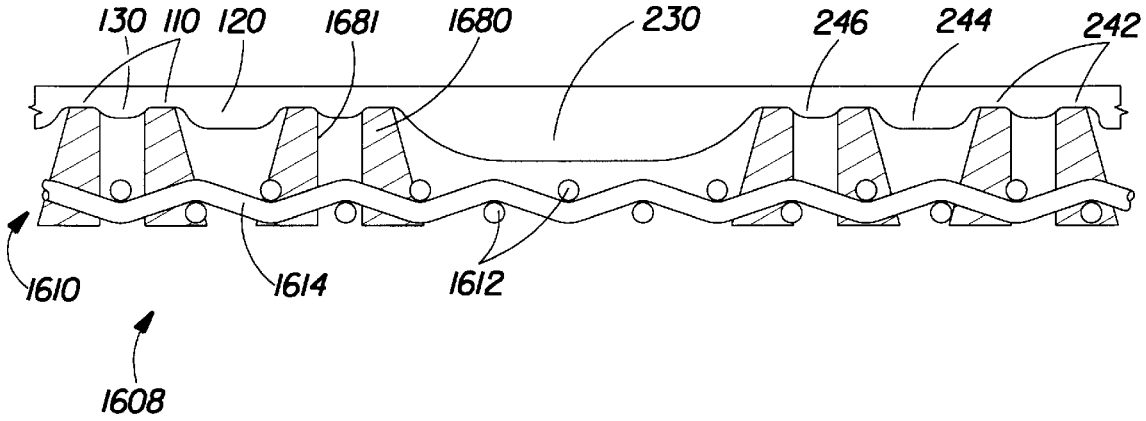
FIG. 23 is a cross-sectional illustration showing an embryonic web supported on a forming element of the type shown in FIG. 22.

FIG. 22 is an illustration of a forming element 1600 which can be used to provide the predetermined variation in basis weights of the type depicted in FIGS. 15–18. FIG. 23 shows an embryonic web supported on the forming element 1600.

Referring to FIGS. 22 and 23, the forming element 1600 comprises a liquid permeable woven base 1610 and flow restriction members 1680 disposed on the woven base 1610. For clarity, only a portion of the woven base 1610 is shown in FIG. 22. The flow restriction members 1680 can be generally annular, with an aperture 1681 extending through each member 1680. The forming element 1600 can comprise between about 100,000 and about 500,000 members 1680 per square meter of the forming element 1600, as viewed in FIG. 22.

The members 1680 can comprise photopolymer resin protrusions which are cast onto the base 1610. The flow restriction members 1680 provide drainage zones corresponding to the background 100 and the cells 240 of a paper structure 20 of the type shown in FIGS. 15–18. The open network 1682 between adjacent members 1680 provides a drainage zone corresponding to the regions 120 and regions 240 in a paper structure of the type shown in FIG. 17. The apertures 1681 provide drainage zones corresponding to the regions 130 and 246 in a paper structure of the type shown in FIG. 17. The upper surfaces of the members 1680 provide zones of virtually no drainage corresponding to regions 110 and 242 in a paper structure of the type shown in FIG. 17.

The flow restriction members 1680 are selectively cast on the base 1610 to provide areas 1684 substantially free of the members 1680. The areas 1684 provide drainage zones corresponding to the high basis weight regions 230 in a paper structure of the type shown in FIG. 17. The areas 1684 shown in FIG. 22 are separate, unconnected segments which together correspond to a single decorative indicia. Alternatively, a single continuous closed path area 1684 could be provided to form each decorative indicia.

The flow restriction members 1680 can be positioned on the base 1610 to have a center to center MD spacing X1 of about 2.0 to about 3.0 mm, a center to center CD spacing X2 of about 2.0 to about 3.0 mm, an MD length X3 of about 1.5 mm to about 2.5 mm, and a CD width X4 of about 1.0 mmto about 1.5 mm. The openings 1681 can have a length X5 of about 0.7 mm to about 1.1 mm, and a width X6 of about 0.5 mm to about 0.9 mm. Flow restriction members 1680 can be selectively omitted from portions of the base 1610 to provide areas 1684 having a channel width C3 of between about 1.5 mm to about 2.5 mm.

The predetermined pattern of densification in the form of regions 330 and 340 can be formed using a web support apparatus such as that shown in FIG. 12. Generally, the number of regions 340 per unit area of the paper structure 20 will be less than the number of regions 110 (or 130) per unit area of the background 100.

FIGS. 24–27 illustrate a paper web 20 according to yet another embodiment of the present invention. The paper structure in FIGS. 24–27 comprises a background portion 100 and about 1 to about 200 discrete, decorative indicia 220 per square foot of the surface 22, as viewed in FIG. 24. The background portion 100 can comprise at least 50 percent of the surface area of the first surface 22, and in one embodiment, the background portion 100 comprises at least 70 percent of the surface area of surface 22.

Each decorative indicia 200 can comprise at least one high basis weight region 230 having a basis weight which is greater than the average basis weight of the surrounding background portion 100. In FIGS. 24–27, each decorative indicia 220 comprises a plurality of high basis weight regions 230.

The decorative pattern 200 in FIGS. 24–27 comprises one or more low basis weight regions. In FIGS. 24–27, the decorative indicia 220 comprise low basis weight regions 290 and 290A. Low basis weight regions 290 and 290A have a basis weight less than the basis weight of the high basis weight regions 230. The low basis weight regions 290 and 290A can substantially circumscribe one or more high basis weight regions 230. The low basis weight regions 290 form a border intermediate the background portion 100. The low basis weight regions 290A form a border intermediate adjacent high basis weight regions. By substantially circumscribing one or more high basis weight regions, the low basis weight regions 290 and 290A help to accentuate the visual appearance of the decorative indicia.

Figure 24:
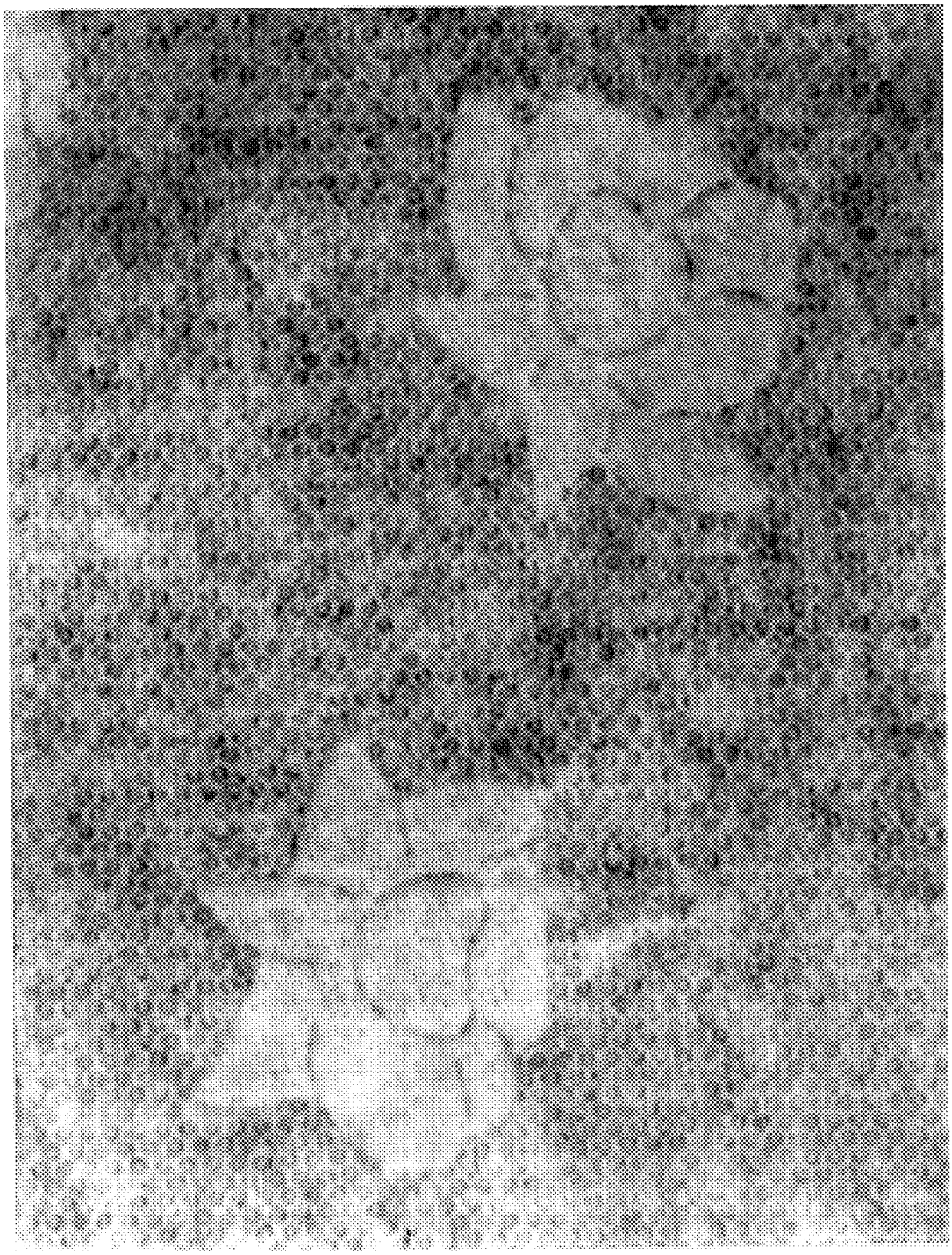
FIG. 24 is a photograph of a portion of a paper web made according to one alternative embodiment of the present invention.
Figure 25:
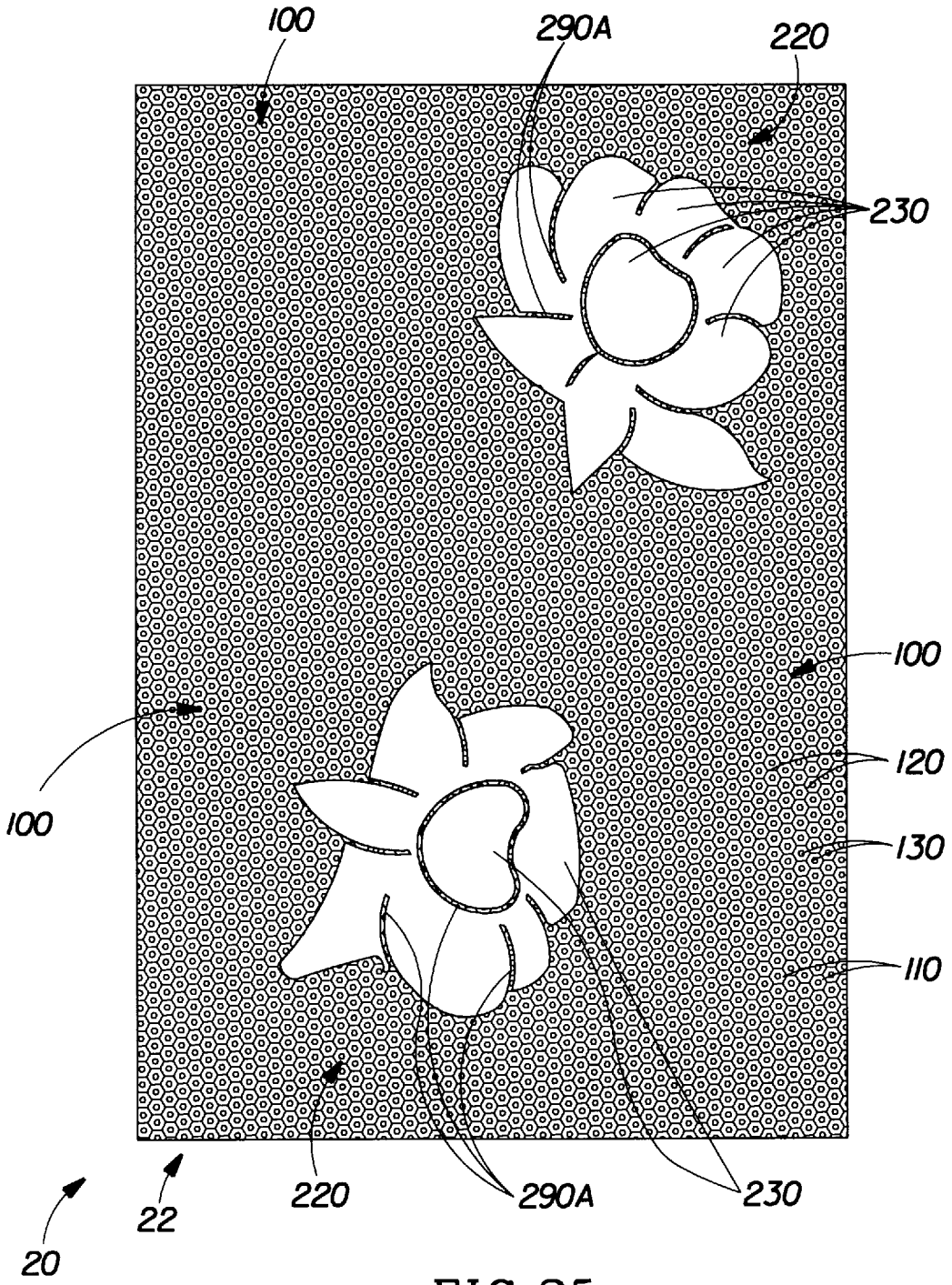
FIG. 25 is a schematic illustration of the paper web shown in FIG. 22.

In FIG. 24, the high basis weight regions 230 comprise at least 70 percent of the surface area of the decorative indicia 220, and the high basis weight regions comprise less than about 30 percent of the surface area of surface 22.

The paper web 20 shown in FIGS. 24–27 has a background portion 100 which comprises at least three regions disposed in a nonrandom, repeating pattern, the regions being distinguishable from each other by basis weight. The background portion 100 comprises a relatively high basis weight, continuous network region 120, a plurality of discrete, relatively lower basis weight regions 110 dispersed throughout the continuous network region 120, and a plurality of discrete regions 130, each region 130 generally encircled by a relatively lower basis weight region 110. The regions 110 are visually distinguishable from the region 120, and the basis weight of the regions 110 is less than the basis weight of the region 120. The regions 130 are visually distinguishable from the regions 110, can have a basis weight which is intermediate the basis weights of the region 120 and the regions 110.

The variation of basis weight within the background 100 and the low basis weight regions 290 and 290A help to make the decorative indicia 220 stand out visually, thereby helping to accentuate the decorative pattern of the paper structure The background portion 100 can have an opacity of at least about 3.0. The high basis weight regions 230 can have an opacity which is greater than that of the background portion, and the high basis weight regions 230 preferably have an opacity which is at least about 4.0.

Figure 26:
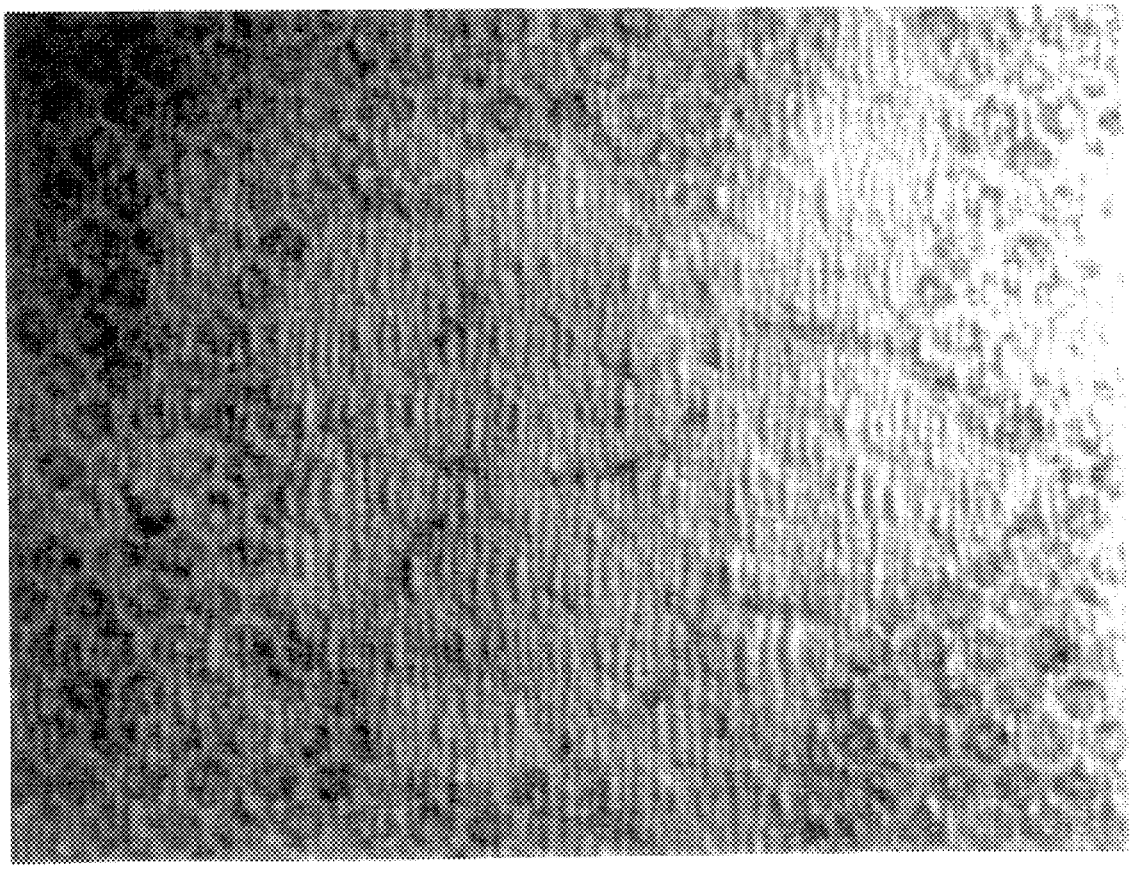
FIG. 26 is a photograph of a portion of a paper web of the type shown in FIG. 24 showing the paper web to have a continuous network region.
Figure 27:
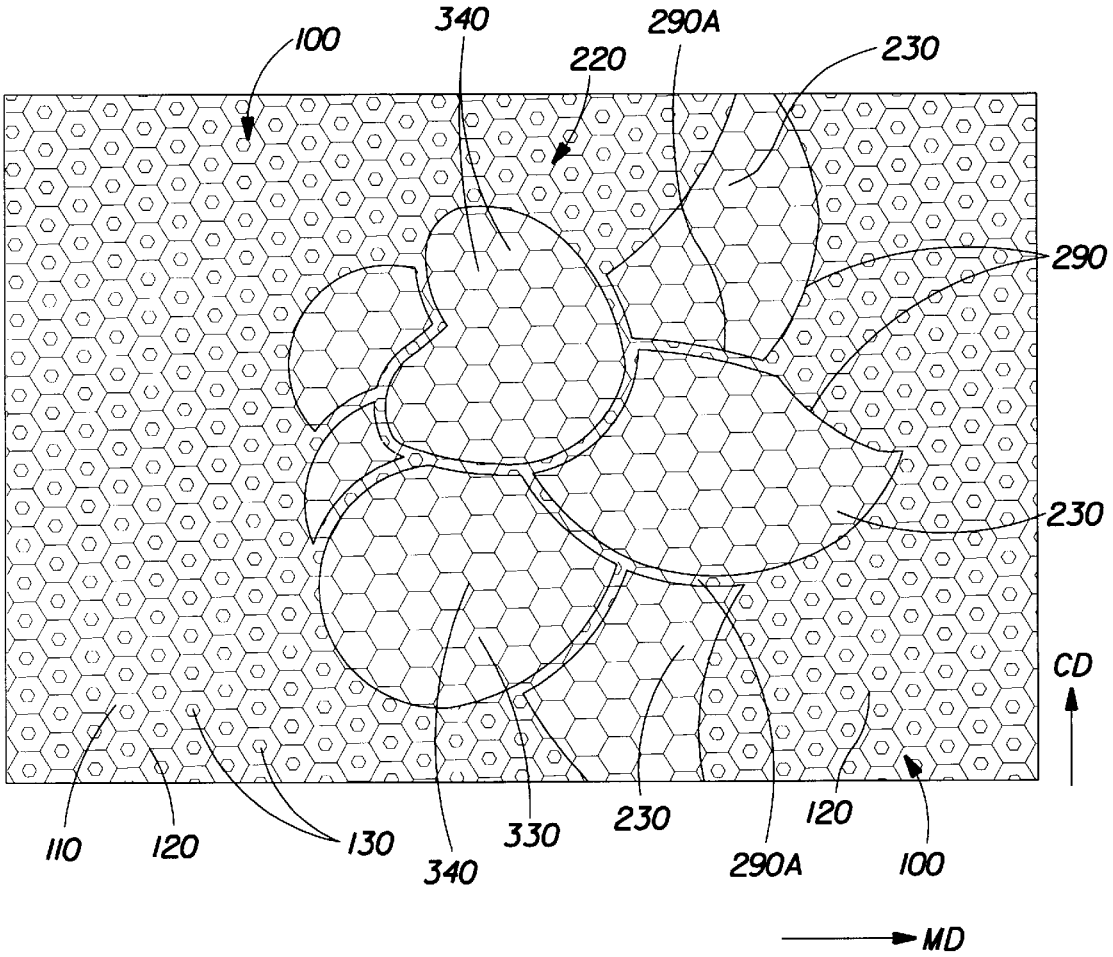
FIG. 27 is a schematic illustration of the paper web shown in FIG. 26.

Referring to FIGS. 26 and 27, the structure 20 can include a continuous network, relatively high density region 330 and a plurality of discrete, relatively low density regions 340 dispersed throughout the continuous network region 330. The continuous network region 330 provides web strength, while the relatively low density regions 340 provide web bulk and absorbency. The regions 330 and 340 are superimposed on the background 100 and the high basis weight regions 230.

Figure 28:
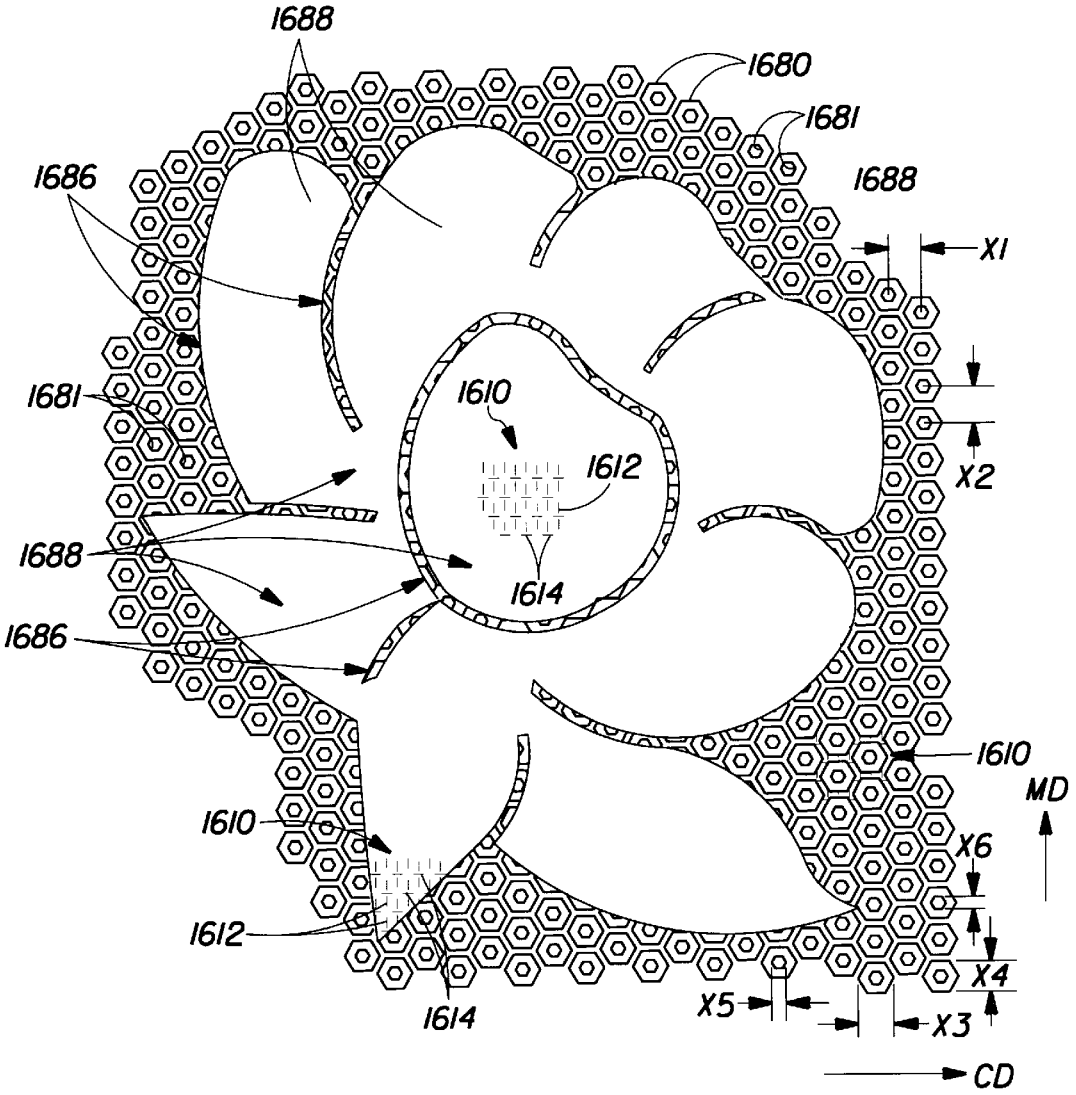
FIG. 28 is a schematic illustration of a forming element which can be used to make a paper web of the type shown in FIG. 24.

FIG. 28 is an illustration of a forming element 1600 which can be used to provide the predetermined variation in basis weights of the type depicted in FIGS. 24–27. The forming element 1600 comprises a liquid permeable woven base 1610 and flow restriction members 1680 disposed on the woven base 1610. For clarity, only a portion of the woven base 1610 is shown in FIG. 28. The flow restriction members 1680 can be generally annular, with an aperture 1681 extending through each member 1680. The forming element 1600 can comprise between about 100,000 and about 500,000 members 1680 per square meter of the forming element 1600, as viewed in FIG. 22.

The forming element 1600 also includes curvilinear flow restriction elements 1686, which correspond to the low basis weight regions 290 and 290A in FIGS. 24–27. The curvilinear flow restriction elements 1686 form the perimeters of resin free areas 1688. The resin free areas 1688 provide a drainage zone corresponding to the high basis weigh regions 230, while the flow restriction elements 1686 provide zones of virtually no drainage corresponding to regions 290 and 290A. The flow restriction elements 1686 can comprise lines of photopolymer resin cured onto the woven element 1610.

The members 1680 can comprise photopolymer resin protrusions which are cast onto the base 1610. The flow restriction members 1680 provide drainage zones corresponding to the background 100. The open network 1682 between adjacent members 1680 provides a drainage zone corresponding to the regions 120. The apertures 1681 provide drainage zones corresponding to the regions 130. The upper surfaces of the members 1680 provide zones of virtually no drainage corresponding to regions 110.

The flow restriction members 1680 are selectively cast on the base 1610 to surround the resin free areas 1688 bordered by flow restriction elements 1686. The flow restriction members 1680 can be positioned on the base 1610 to have dimensions X1–X6 as described above for the embodiment in FIG. 22. The flow restriction elements 1686 can have a width of less than about 0.010 inch.

The predetermined pattern of densification in the form of regions 330 and 340 can be formed using a web support apparatus such as that shown in FIG. 12. Generally, the number of regions 340 per unit area of the paper structure 20 will be greater than the number of regions 110 (or 130) per unit area of the background 100.

EXAMPLES

The following examples illustrate the practice of the present invention but are not intended to be limiting thereof.

Example 1

First, a 3% by weight aqueous slurry of Northern Softwood Kraft (NSK) fibers is made using a conventional re-pulper. A 2% solution of the temporary wet strength resin (i.e., PAREZ® 750 marketed by American Cyanamid corporation of Stanford, Conn.) is added to the NSK stock pipe at a rate of 0.2% by weight of the dry fibers. The NSK slurry is diluted to about 0.2% consistency at the fan pump. Second, a 3% by weight aqueous slurry of Eucalyptus fibers is made up using a conventional re-pulper. A 2% solution of the debonder (i.e., Adogen® SDMC marketed by Witco Corporation of Dublin, Ohio) is added to the Eucalyptus stock pipe at a rate of 0.1% by weight of the dry fibers. The Eucalyptus slurry is diluted to about 0.2% consistency at the fan pump.

The treated furnish streams are mixed in the headbox to provide a homogeneous fiber blend, and deposited onto a forming element of the type shown in FIGS. 9–11. Dewatering occurs in simultaneous stages through the forming element, and is assisted by a deflector and vacuum boxes. The forming element comprises a photopolymer resin cast on a wire manufactured by Appleton Wire of Appleton, Wisconsin, the wire being a triple-layer square weave configuration having 90 machine-direction and 72 cross-machine-direction monofilaments per inch, respectively. The monofilament diameter ranges from about 0.15 mm to about 0.20 mm. The wire has an air permeability of about 1050 scfm. The photopolymer resin is cast on the wire to provide a difference in elevation D (FIG. 11) of less than about 0.006 inch. The value of C is about 2.0 mm, the value of W is about 0.3 mm, the value C2 is about 0.5 mm, and the value of W2 is about 0.3 mm.

The embryonic wet web is transferred from the forming element, at a fiber consistency of about 10% at the point of transfer, to a dewatering felt. The dewatering felt 220 is a Amflex 2 Press Felt manufactured by Appleton Mills. The felt comprises a batt of nylon fibers. The batt has a surface denier of 3, a substrate denier of 10–15. The felt has a basis weight of 1436 gm/square meter, a caliper of about 3 millimeter, and an air permeability of about 30 to about 40 scfm.

The embryonic web is transferred to the felt to form a generally monoplanar web 545. Transfer is provided at the vacuum transfer point with a pressure differential of about 20 inches of mercury. Further de-watering is accomplished by vacuum assisted drainage until the web has a fiber consistency of about 25%. The web 545 is carried to nip as shown in FIG. 8. The vacuum pressure roll has a surface hardness of about 60 P&J. The web 545 is compacted against the surface of the Yankee dryer drum by pressing the web 545 and the felt between the vacuum pressure roll and the Yankee dryer drum at a compression pressure of at least about 200 psi. The fiber consistency is increased to at least about 90% before dry creping the web with a doctor blade. The doctor blade has a bevel angle of about 20 degrees and is positioned with respect to the Yankee dryer to provide an impact angle of about 76 degrees; the Yankee dryer is operated at about 800 fpm (feet per minute) (about 244 meters per minute). The dry web is formed into roll at a speed of 650 fpm (200 meters per minutes).

The decorative web is converted into a homogenous, two-ply bath tissue paper having the wire side (surface 22 in FIG. 5) facing outwardly. The two-ply toilet tissue paper has a basis weight of about 25 pounds per 3000 square feet, and contains about 0.2% of the temporary wet strength resin and about 0.1% of the debonder. The resulting two-ply tissue paper is soft, absorbent, aesthetic and is suitable for use as bath tissues.

Example 2

First, a 3% by weight aqueous slurry of Northern Softwood Kraft (NSK) fibers is made using a conventional re-pulper. A 2% solution of the temporary wet strength resin (i.e., PAREZ® 750 marketed by American Cyanamid corporation of Stanford, Conn.) is added to the NSK stock pipe at a rate of 0.2% by weight of the dry fibers. The NSK slurry is diluted to about 0.2% consistency at the fan pump. Second, a 3% by weight aqueous slurry of Eucalyptus fibers is made up using a conventional re-pulper. A 2% solution of the debonder (i.e., Adogen® SDMC marketed by Witco Corporation of Dublin, Ohio) and a 2% solution of dry strength binder (i.e., Redibond® 5320 marketed by National Starch and Chemical corporation of New York, N.Y.) are added to the Eucalyptus stock pipe at a rate of 0.1% by weight of the dry fibers. The Eucalyptus slurry is diluted to about 0.2% consistency at the fan pump.

The individual treated furnish streams (stream 1=100% NSK/stream 2=100% Eucalyptus) are separated in the headbox and deposited onto a forming element of the type shown in FIGS. 9–11. Dewatering occurs in simultaneous stages through the forming element, and is assisted by a deflector and vacuum boxes. The forming element comprises a photopolymer resin cast on a wire manufactured by Appleton Wire of Appleton, Wisconsin, the wire being a triple-layer square weave configuration having 90 machine-direction and 72 cross-machine-direction monofilaments per inch, respectively. The monofilament diameter ranges from about 0.15 mm to about 0.20 mm. The wire has an air permeability of about 1050 scfm. The photopolymer resin is cast on the wire to provide a difference in elevation D (FIG. 11) of less than about 0.006 inch. The value of C is about 2.0 mm, the value of W is about 0.3 mm, the value C2 is about 0.5 mm, and the value of W2 is about 0.3 mm.

The embryonic wet web is transferred from the forming element, at a fiber consistency of about 10% at the point of transfer, to a web support apparatus comprising a photopolymer resin layer joined to a dewatering felt, as shown in FIG. 12. The dewatering felt is a Amflex 2 Press Felt manufactured by Appleton Mills. The web support apparatus has a continuous network surface and about 60–80 openings

2270 (FIG. 12) per square inch. The resin has a projected area equal to about 35 percent of the projected area of the web support apparatus. The difference in elevation between the resin web contacting surface and the felt surface is about 0.005 inch (0.127 millimeter).

The embryonic web is transferred to the web support apparatus to form a generally monoplanar web 545. Transfer is provided at the vacuum transfer point with a pressure differential of about 20 inches of mercury. Further de-watering is accomplished by vacuum assisted drainage until the web has a fiber consistency of about 25%. The web 545 is carried to nip as shown in FIG. 8. The vacuum pressure roll has a surface hardness of about 60 P&J. The web 545 is compacted against the surface of the Yankee dryer drum by pressing the web 545 and the web support apparatus between the vacuum pressure roll and the Yankee dryer drum at a calculated compression pressure at the resin surface of at least about 800 psi, as calculated by dividing the nip load in pli (pounds per cross machine direction lineal inch) by the nip width in the machine direction and the decimal percentage of the resin surface area per unit projected area of the web support apparatus (0.35). The fiber consistency is increased to at least about 90% before dry creping the web with a doctor blade. The doctor blade has a bevel angle of about 20 degrees and is positioned with respect to the Yankee dryer to provide an impact angle of about 76 degrees; the Yankee dryer is operated at about 800 fpm (feet per minute) (about 244 meters per minute). The dry web is formed into roll at a speed of 650 fpm (200 meters per minutes).

The decorative web is converted into a two-ply (each ply comprising an outer hardwood layer and an inner softwood layer) bath tissue paper having the wire side (surface 22 in FIG. 5) facing outwardly. The two-ply toilet tissue paper has a basis weight of about 25 pounds per 3000 square feet, and contains about 0.2% of the temporary wet strength resin and about 0.1% of the debonder. The resulting two-ply tissue paper is soft, absorbent, aesthetic and is suitable for use as bath tissues.

Example 3

First, a 3% by weight aqueous slurry of Northern Softwood Kraft (NSK) fibers is made using a conventional re-pulper. A 2% solution of the temporary wet strength resin (i.e., PAREZ® 750 marketed by American Cyanamid corporation of Stanford, Conn.) is added to the NSK stock pipe at a rate of 0.2% by weight of the dry fibers. The NSK slurry is diluted to about 0.2% consistency at the fan pump. Second, a 3% by weight aqueous slurry of Eucalyptus fibers is made up using a conventional re-pulper. A 2% solution of the debonder (i.e., Adogen® SDMC marketed by Witco Corporation of Dublin, Ohio) and a 2% solution of dry strength binder (i.e., Redibond® 5320 marketed by National Starch and Chemical corporation of New York, N.Y.) are added to the Eucalyptus stock pipe at a rate of 0.1% by weight of the dry fibers. The Eucalyptus slurry is diluted to about 0.2% consistency at the fan pump.

The individual treated furnish streams (stream 1=100% NSK/stream 2=100% Eucalyptus) are separated in the headbox and deposited onto a forming element of the type shown in FIGS. 22–23 (Alternatively, a forming element of the type shown in FIG. 28 can be used). Dewatering occurs in simultaneous stages through the forming element, and is assisted by a deflector and vacuum boxes. The forming element comprises a photopolymer resin cast on a wire manufactured by Appleton Wire of Appleton, Wis., the wire being a triple-layer square weave configuration having 90 machine-direction and 72 cross-machine-direction monofilaments per inch, respectively. The monofilament diameter ranges from about 0.15 mm to about 0.20 mm. The wire has an air permeability of about 1050 scfm. The photopolymer resin is cast on the wire to provide a difference in elevation D (FIG. 11) of less than about 0.006 inch. Referring to FIG. 22, the value of C3 is about 2.0 mm, the value of X1 is about 2.4 mm, the value of X2 is about 2.5 mm, the value of X3 is about 1.9 mm, the value of X4 is about 1.3 mm. The openings 1681 have an MD length X5 of about 0.9 mm, and a CD width X6 of about 0.7 mm. The value of C3 is about 2.0 mm.

The embryonic wet web is transferred from the forming element, at a fiber consistency of about 10% at the point of transfer, to a web support apparatus comprising a photopolymer resin layer joined to a dewatering felt, as shown in FIG. 12. The dewatering felt is a Amflex 2 Press Felt manufactured by Appleton Mills of Appleton, Wis. The web support apparatus has a continuous network surface and about 60–80 openings 2270 (FIG. 12) per square inch. The resin has a projected area equal to about 35 percent of the projected area of the web support apparatus. The difference in elevation between the resin web contacting surface and the felt surface is about 0.005 inch (0.127 millimeter).

The embryonic web is transferred to the web support apparatus to form a generally monoplanar web 545. Transfer is provided at the vacuum transfer point with a pressure differential of about 20 inches of mercury. Further dewatering is accomplished by vacuum assisted drainage until the web has a fiber consistency of about 25%. The web 545 is carried to nip as shown in FIG. 8. The vacuum pressure roll has a surface hardness of about 60 P&J. The web 545 is compacted against the surface of the Yankee dryer drum by pressing the web 545 and the web support apparatus between the vacuum pressure roll and the Yankee dryer drum at a calculated compression presure at the resin surface of at least about 800 psi, as calculated by dividing the nip load in pli (pounds per cross machine direction lineal inch) by the nip width in the machine direction and the decimal percentage of the resin surface area per unit projected area of the web support apparatus (0.35). The fiber consistency is increased to at least about 90% before dry creping the web with a doctor blade. The doctor blade has a bevel angle of about 20 degrees and is positioned with respect to the Yankee dryer to provide an impact angle of about 76 degrees; the Yankee dryer is operated at about 800 fpm (feet per minute) (about 244 meters per minute). The dry web is formed into roll at a speed of 650 fpm (200 meters per minutes).

The decorative web is converted into a two-ply (each ply comprising an outer hardwood layer and an inner softwood layer) bath tissue paper having the wire side (surface 22 in FIG. 5) facing outwardly. The two-ply toilet tissue paper has a basis weight of about 25 pounds per 3000 square feet, and contains about 0.2% of the temporary wet strength resin and about 0.1% of the debonder. The resulting two-ply tissue paper is soft, absorbent, aesthetic and is suitable for use as bath tissues.

Example 4

First, a 3% by weight aqueous slurry of Northern Softwood Kraft (NSK) fibers is made using a conventional re-pulper. A 2% solution of the temporary wet strength resin (i.e., PAREZ® 750 marketed by American Cyanamnid corporation of Stanford, Conn.) is added to the NSK stock pipe at a rate of 0.2% by weight of the dry fibers. The NSK slurry is diluted to about 0.2% consistency at the fan pump. Second, a 3% by weight aqueous slurry of Eucalyptus fibers is made up using a conventional re-pulper. A 2% solution of the debonder (i.e., Adogen® SDMC marketed by Witco Corporation of Dublin, Ohio) and a 2% solution of dry strength binder (i.e., Redibond® 5320 marketed by National Starch and Chemical corporation of New York, N.Y.) are added to the Eucalyptus stock pipe at a rate of 0.1% by weight of the dry fibers. The Eucalyptus slurry is diluted to about 0.2% consistency at the fan pump.

The individual treated furnish streams (stream 1=100% NSK/stream 2=100% Eucalyptus) are separated in the headbox and deposited onto a forming element of the type shown in FIGS. 9–11. Dewatering occurs in simultaneous stages through the forming element, and is assisted by a deflector and vacuum boxes. The forming element comprises a photopolymer resin cast on a wire manufactured by Appleton Wire of Appleton, Wis., the wire being a triple-layer square weave configuration having 90 machine-direction and 72 cross-machine-direction monofilaments per inch, respectively. The monofilament diameter ranges from about 0.15 mm to about 0.20 mm. The wire has an air permeability of about 1050 scfm. The photopolymer resin is cast on the wire to provide a difference in elevation D (FIG. 11) of less than about 0.006 inch. The value of C is about 2.0 mm, the value of W is about 0.3 mm, the value C2 is about 0.5 mm, and the value of W2 is about 0.3 mm.

The embryonic wet web is transferred from the forming element at a fiber consistency of about 10% at the point of transfer, to a woven, through air drying/imprinting fabric. The drying/imprinting fabric has discrete web imprinting knuckles, and is of the type described generally in U.S. Pat. No. 4,191,609, which patent is incorporated herein by reference. Such a drying imprinting fabric provides bilaterally staggered compressed and uncompressed zones, as shown in U.S. Pat. No. 4,191,609. The compressed zones provide regions of relatively high density, and the uncompressed zones provide regions of relatively low density.

Further de-watering is accomplished by vacuum assisted drainage until the web has a fiber consistency of about 28%. The web is pre-dried by through air drying to a fiber consistency of about 65% by weight, and carried to the nip 800 shown in FIG. 8. The web is adhered to the surface of a Yankee dryer with a sprayed creping adhesive comprising 0.25% aqueous solution of Polyvinyl Alcohol (PVA).

The web is removed from the Yankee dryer dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is formed into roll at a speed of 650 fpm (200 meters per minutes).

The decorative web is converted into a two-ply (each ply comprising an outer hardwood layer and an inner softwood layer) bath tissue paper having the wire side (surface 22 in FIG. 5) facing outwardly. The two-ply toilet tissue paper has a basis weight of about 25 pounds per 3000 square feet, and contains about 0.2% of the temporary wet strength resin and about 0.1% of the debonder. The resulting two-ply tissue paper is soft, absorbent, aesthetic and is suitable for use as bath tissues.

Example 5

First, a 3% by weight aqueous slurry of Northern Softwood Kraft (NSK) fibers is made using a conventional re-pulper. A 2% solution of the temporary wet strength resin (i.e., PAREZ® 750 marketed by American Cyanamid corporation of Stanford, Conn.) is added to the NSK stock pipe at a rate of 0.2% by weight of the dry fibers. The NSK slurry is diluted to about 0.2% consistency at the fan pump. Second, a 3% by weight aqueous slurry of Eucalyptus fibers is made up using a conventional re-pulper. A 2% solution of the debonder (i.e., Adogene SDMC marketed by Witco Corporation of Dublin, Ohio) is added to one of the Eucalyptus stock pipe at a rate of 0.5% by weight of the dry fibers. The Eucalyptus slurry is diluted to about 0.2% consistency at the fan pump. Third, a 3% by weight aqueous slurry of Eucalyptus fibers is made up using a conventional re-pulper. A 2% solution of the debonder (i.e., Adogen® SDMC marketed by Witco Corporation of Dublin, Ohio) and a 2% solution of dry strength binder (i.e., Redibond® 5320 marketed by National Starch and Chemical corporation of New York, N.Y.) are added to the Eucalyptus stock pipe at a rate of 0.1% by weight of the dry fibers. The Eucalyptus slurry is diluted to about 0.2% consistency at the fan pump.

The individual treated furnish streams (stream 1=100% NSK/stream 2=100% debonded Eucalyptus/stream 3=100% Eucalyptus) are separated in the headbox and deposited onto a forming element of the type shown in FIGS. 22–23 (Alternatively, a forming element of the type shown in FIG. 28 can be used). Dewatering occurs in simultaneous stages through the forming element, and is assisted by a deflector and vacuum boxes. The forming element comprises a photopolymer resin cast on a wire manufactured by Appleton Wire of Appleton, Wis., the wire being a triple-layer square weave configuration having 90 machine-direction and 72 cross-machine-direction monofilaments per inch, respectively. The monofilament diameter ranges from about 0.15 mm to about 0.20 mm. The wire has an air permeability of about 1050 scfm. The photopolymer resin is cast on the wire to provide a difference in elevation D (FIG. 11) of less than about 0.006 inch. Referring to FIG. 22, the value of C3 is about 2.0 mm, the value of X1 is about 2.4 mm, the value of X2 is about 2.5 mm, the value of X3 is about 1.9 mm, the value of X4 is about 1.3 mm. The openings 1681 have an MD length X5 of about 0.9 mm, and a CD width X6 of about 0.7 mm. The value of C3 is about 2.0 mm.

The embryonic wet web is transferred from the forming element, at a fiber consistency of about 10% at the point of transfer, to a web support apparatus comprising a photopolymer resin layer joined to a dewatering felt, as shown in FIG. 12. The dewatering felt is a Amflex 2 Press Felt manufactured by Appleton Mills of Appleton, Wis. The web support apparatus has a continuous network surface and about 60–80 openings 2270 (FIG. 12) per square inch. The resin has a projected area equal to about 35 percent of the projected area of the web support apparatus. The difference in elevation between the resin web contacting surface and the felt surface is about 0.005 inch (0.127 millimeter).

The embryonic web is transferred to the web support apparatus to form a generally monoplanar web 545. Transfer is provided at the vacuum transfer point with a pressure differential of about 20 inches of mercury. Further de-watering is accomplished by vacuum assisted drainage until the web has a fiber consistency of about 25%. The web 545 is carried to nip as shown in FIG. 8. The vacuum pressure roll has a surface hardness of about 60 P&J. The web 545 is compacted against the surface of the Yankee dryer drum by pressing the web 545 and the web support apparatus between the vacuum pressure roll and the Yankee dryer drum at a calculated compression pressure at the resin surface of at least about 800 psi, as calculated by dividing the nip load in pli (pounds per cross machine direction lineal inch) by the nip width in the machine direction and the decimal percentage of the resin surface area per unit projected area of the web support apparatus (0.35). The fiber consistency is increased to at least about 90% before dry creping the web with a doctor blade. The doctor blade has a bevel angle of about 20 degrees and is positioned with respect to the Yankee dryer to provide an impact angle of about 76 degrees; the Yankee dryer is operated at about 800 fpm (feet per minute) (about 244 meters per minute). The dry web is formed into roll at a speed of 650 fpm (200 meters per minutes).

The decorative web is converted into a two-ply (each ply comprising two outer hardwood layers and an inner softwood layer) bath tissue paper having the wire side (surface 22 in FIG. 5) facing outwardly. The two-ply toilet tissue paper has a basis weight of about 25 pounds per 3000 square feet, and contains about 0.2% of the temporary wet strength resin and about 0.1% of the debonder. The resulting two-ply tissue paper is soft, absorbent, aesthetic and is suitable for use as bath tissues.

TEST METHODS

Total Tensile Strength:

The total tensile strength of a paper web is measured according the procedure for measuring "Dry Tensile Strength" set forth in U.S. Pat. No. 4,225,382 issued Sep. 30, 1980 to Kearney et al., which patent is incorporated by reference.

MD and CD Stretch:

MD (machine direction) and CD (cross machine direction) stretch are measured according to the procedure for measuring "Stretch" set forth in U.S. Pat. No. 4,225,382, which is incorporated herein by reference.

Burst Strength:

The dry burst strength of the tissue is determined using a Thwing-Albert Burst tester cat. No. 177, equipped with a 2000 gram load cell, obtained from Thwing-Albert Instrument Co., 10960 Dutton road, Philadelphia, Pa. 19154. Tissue samples are placed in a conditioned room at a temperature of about 73+/−2 degrees Fahrenheit and about 50+/−2% relative humidity for at least about 24 hours. A paper cutter is used to cut eight strips approximately 4.5 inches wide CD) by 12 inches long (MD) for testing. Each strip is placed on the lower ring of the sample holding device with the wire side facing up, so the sample completely covers the opening in the lower ring, and a small amount of sample extends over the outer diameter of the lower ring. After the sample strip is properly in place on the lower ring, the upper ring is lowered with the pneumatic holding device so that the sample is held between the upper and lower rings. The diameter of the opening in the lower ring is about 3.5 inches, the plunger has a diameter of about 0.6 inches. The tester is activated, so that the plunger rises at a speed of about 5 inches per minute and ruptures the paper. The tester provides the value of burst strength directly in grams at the time of sample rupture. The 8 test results obtained for the eight sample strips are averaged and the burst value of the paper sample is recorded to the nearest gram.

Surface Smoothness:

The surface smoothness of a side of a paper web is measured based upon the method for measuring physiological surface smoothness (PSS) set forth in the 1991 International Paper Physics Conference, TAPPI Book 1, article entitled "Methods for the Measurement of the Mechanical Properties of Tissue Paper" by Ampulski et al. found at page 19, which article is incorporated herein by reference. The PSS measurement as used herein is the point by point sum of amplitude values as described in the above article. The measurement procedures set forth in the article are also generally described in U.S. Pat. No. 4,959,125 issued to Spendel and U.S. Pat. No. 5,059,282 issued to Ampulski et al, which patents are incorporated herein by reference.

For purposes of testing the paper samples of the present invention, the method for measuring PSS in the above article is used to measure surface smoothness, with the following procedural modifications:

Instead of importing digitized data pairs (amplitude and time) into SAS software for 10 samples, as described in the above article, the Surface Smoothness measurement is made by acquiring, digitizing, and statistically processing data for the 10 samples using LABVIEW brand software available from National Instruments of Austin, Tex. Each amplitude spectrum is generated using the "Amplitude and Phase Spectrum.vi" module in the LABVIEW software package, with "Amp Spectrum Mag Vrms" selected as the output spectrum. An output spectrum is obtained for each of the 10 samples.

Each output spectrum is then smoothed using the following weight factors in LABVIEW: 0.000246, 0.000485, 0.00756, 0.062997. These weight factors are selected to imitate the smoothing provided by the factors 0.0039, 0.0077, 0.120, 1.0 specified in the above article for the SAS program.

After smoothing, each spectrum is filtered using the frequency filters specified in the above article. The value of PSS, in microns, is then calculated as described in the above mentioned article, for each individually filtered spectrum. The Surface Smoothness of the side of a paper web is the average of the 10 PSS values measured from the 10 samples taken from the same side of the paper web. Similarly, the Surface Smoothness of the opposite side of the paper web can be measured. The smoothness ratio is obtained by dividing the higher value of Surface Smoothness, corresponding to the more textured side of the paper web, by the lower value of Surface Smoothness, corresponding to the smoother side of the paper web.

Opacity:

Tissue samples to be measured are placed together, along with the X-Rite transmission density standard having standard density strips (#61254; X-Rite Corp, Grandville, Mich.), on the face plate of an AGFA Arcus II flat bed scanner (Bayer Corp, Wilmington Mass.). The samples and standard are scanned at 240 dpi using the automatic gray scale settings of the AGFA FotoLook v3.00.00 software and the image (5.57"×8.50") saved as a 16 bit TIFF digital file using a Dell Dimension XPS266 PII (Dell Computers, Austin, Tex.) running under Microsoft (Redmond, Wash.) Windows 95.

The resulting image is imported into the Optimas V6.11 image analysis software (Optimas Corp, Bothell, Wash.). The intensity calibration function is used to identify three standard density strips and register three calibration values (0.04, 024, and 1.49 optical density) corresponding to those strips using the mean log inverse gray value (mLIGV) density mode. The calibration showed an r squared value of 0.9999 with a residual of 0.0077 density value.

An ROI (Region of Interest) is defined for each tissue paper region (eg. Background 100, high basis weight region 230) to be measured. The ROI is defined using the polygon region-of-interest (ROI) tool within Optimas. The Data Explorer utility within Optimas is then used to measure the mLIGV (Optical Density) of each of the ROI's and the results are saved to a spreadsheet file (e.g. using EXCEL brand or other suitable spreadsheet software).

Opacity is defined as:

Optical Density=Log (Opacity)

and

Opacity=(Io/It)

where

=incident light intensity

It=transmitted light intensity

The reported opacity (non-dimensional) is calculated as the inverse log (base 10) of the measured optical density.

Basis Weight:

The basis weight of the web (macro basis weight) is measured using the following procedure.

The paper to be measured is conditioned at 71–75 degrees Fahrenheit at 48 to 52 percent relative humidity for a minimum of 2 hours. The conditioned paper is cut to provide twelve samples measuring 3.5 inch by 3.5 inch. The samples are cut, six samples at a time, with a suitable pressure plate cutter, such as a Thwing-Albert Alfa Hydraulic Pressure Sample Cutter, Model 240-10. The two six sample stacks are then combined into a 12 ply stack and conditioned for at least 15 additional minutes at 71 to 75 degrees Fahrenheit and 48 to 52 percent relative humidity.

The 12 ply stack is then weighed on a calibrated analytical balance. The balance is maintained in the same room in which the samples were conditioned. A suitable balance is made by Sartorius Instrument Company, Model A200S. This weight is the weight in grams of a 12 ply stack of the paper, each ply having an area of 12.25 square inches.

The basis weight of the paper web (the weight per unit area of a single ply) is calculated in units of pounds per 3,000 square feet, using the following equation:

Weight of 12 ply stack (grams)×3000×144 sq inch per sq ft.

(453.6 gm/lb)×(12 plies)×(12.25 sq. in. per ply)

or simply: Basis Weight (lb/3,000 $ft^2$)=

Weight of 12 ply stack (gm)×6.48

Basis Weight of Background:

The basis weight of the background portion 100 of the web is measured using the following procedure. Samples of the background portion (samples do not include decorative indicia or portions of decorative indicia) are cut from the paper web. The samples are cut to be as large as possible without including decorative indicia. The area of each sample is measured, and the sample is weighed. The basis weight of the background is calculated by dividing the weight of the sample by the area of the sample. At least three samples are measured and the results averaged to obtain the average basis weight of the background portion.

The average basis weight of the cells 240 can be measured in generally the same manner in which the basis weight of the background portion is measured, except that the sample of the cell 240 is cut from the decorative indicia without including the high basis weight region 230.

Basis Weight of High Basis Weight Regions:

The basis weight of the high basis weight regions 230 can be determined using image analysis techniques. A procedure for measuring the basis weight of the regions 230 is set forth below.

The surface area of the high basis weight regions 230 is determined using a computer, a scanner, and an image analysis software program. A suitable computer is a Dell Dimension XPS-266 Mhz Pentium II computer, or other suitable computer. A suitable scanner is an AGFA Arcus II brand scanner available from AGFA-Gevaert N.V. of Belgium and having 600 dpi resolution. Suitable image analysis software is Optimas Version 6.1 available from Optimas Corp., Bothell, Wash.

The following procedure is used to scan samples and measure the surface area of the high basis weight regions in the sample. Samples are cut from a paper web, each sample including a decorative indicia surrounded by the background. Each sample is weighed to obtain the total weight, TW, of the sample.

Each sample is mounted on a piece of black paper to provide a dark background during scanning. The mounted sample is scanned using the AGFA Arcus II scanner. The images are scanned into the computer using Adobe Photoshop Version 4.0 brand software. The Adobe software is augmented with a FotoLook P.S. 2.09 brand plugin module available from AGFA-Gevaert. The scan settings are set to: automatic, 600 dpi resolution, greyscale (not color). The mounted sample is scanned along with a ruler to provide geometric calibration.

The scanned image for each sample is then opened in image analysis software and calibrated with the ruler image. The calibration factor is about 235.2 pixels per millimeter. The image analysis software is used to measure the total area of the sample based on the perimeter of the sample.

The image analysis software is used to outline the high basis weight regions and calculate the total surface area of the high basis weight regions. The Polygon Region of Interest Tool provided with the Optimus software can be used to outline the high basis weight regions. The areas of the outlined high basis weight regions can be determined using the Measurement Explorer tool (parameter mArArea) provided with the Optimus software.

Once the surface area of the high basis weight regions has been measured using the image analysis software, the basis weight of the high basis weight regions is determined by solving for BW1 in the following equation:

TW=(BW1)×(AREA1)+(BW2)×(AREA2)

where TW is the total weight of the sample having the decorative indicia, BW1 is the basis weight of the high basis weight regions, AREA1 is the area of the high basis weight regions measured using the image analysis software, BW2 is the basis weight of the background region which can be measured from samples cut from the background as described above, and AREA2 is the total area of the sample (calculated based on the perimeter of the sample) minus the value of AREA1. Accordingly, the above equation can be used to solve for the value of BW1. At least three samples are measured and the results averaged to determine the basis weight of the high basis weight regions.

For the case where the high basis weight regions are of the type shown in FIG. 24, the basis weight of the high basis weight regions can be measured as described above for the background 100 (or cells 240). The largest samples possible of the high basis weight regions can be cut from the tissue sample. The area of the samples and the weight of the samples can be measured to determine the basis weight of the high basis weight regions. At least three samples are measured and the results averaged to determine the basis weight of the high basis weight regions.

What is claimed is:

1. A method of producing a paper web having at least two regions disposed in a nonrandom, repeating pattern and being distinguishable from each other by at least one property selected from the group consisting of basis weight, density, thickness, and fiber composition; the method comprising the steps of:

providing a plurality of fibers suspended in a liquid carrier;

providing a fiber retentive forming element having liquid pervious zones;

depositing the fibers and the liquid carrier onto the forming element;

draining the liquid carrier through the forming element in simultaneous stages to form a web having a background portion and a decorative pattern, wherein the decorative pattern comprises at least one high basis weight region having a basis weight which is greater than the basis weight of the surrounding background portion; said high basis weight region forming at least a portion of a border defining the shape of decorative indicia.

2. The method of claim 1 further comprising the steps of:

providing a web support apparatus having a web patterning surface;

transferring the web from the forming element to the web patterning surface of the web support apparatus;

selectively densifying at least a portion of the background portion of the web to provide a nonrandom, repeating pattern of higher and lower density regions in the background portion.

3. The method of claim 1 wherein the step of providing a plurality of fibers comprises providing relatively long fibers and relatively short fibers.

4. The method of claim 3 wherein the step of depositing the fibers on the forming element comprises depositing a mixture of hardwood fibers and softwood fibers on the forming element.

5. The method of claim 1 wherein the step of draining the liquid carrier through the forming element comprises forming an embryonic web having a decorative pattern comprising between about 1 and about 200 discrete decorative indicia per square foot of the web.

6. The method of claim 2 wherein the step of selectively densifying at least a portion of the background comprises providing a continuous network, higher density region and a plurality of lower density regions dispersed throughout the continuous network, high density region.

7. The method of claim 6 wherein the step of selectively densifying at least a portion of the background comprises providing at least about 10,000 relatively low density regions per square meter of the web.

8. The method of claim 7 wherein the step of draining the liquid carrier through the forming element comprises forming an embryonic web having between about 1 and about 200 discrete decorative indicia per square foot of the web.

9. The method of claim 1 wherein the step of draining the liquid carrier through the forming element comprises forming a background portion having at least two different basis weight regions.

10. The method of claim 9 further comprising the step of:

selectively densifying at least a portion of the background portion of the web to provide a nonrandom, repeating pattern of high and low density regions.

11. A method of producing a paper web having a decorative pattern, the method comprising the steps of:

providing at least three regions disposed in a nonrandom, repeating pattern, the three regions being distinguishable from each other by basis weight, the at least three regions forming a background portion and a non-embossed decorative pattern, wherein at least a portion of the decorative pattern forms a border defining the shape of a decorative indicia, and has an opacity greater than that of the background portion.

12. The method of claim 11 wherein the background portion comprises at least two regions disposed in a nonrandom, repeating pattern, the at least two regions being distinguishable from each other by basis weight.

13. The method of claim 12 wherein the background portion comprises at least three regions disposed in a nonrandom, repeating pattern.

14. The method of claim 11 wherein the decorative pattern comprises at least one low basis weight region providing a border intermediate at least a portion of the decorative pattern and the background portion.

15. The method of claim 14 wherein at least one low basis weight region substantially circumscribes one or more high basis weight regions.

16. The method of claim 11 further comprising the step of selectively compacting portions of the web to provide a thinner, continuous network region and a plurality of discrete, thicker regions dispersed throughout the continuous network region.

17. The method of claim 11 wherein the step of providing the decorative pattern comprises providing a plurality of discrete, decorative indicia, wherein each decorative indicia is separated from adjacent decorative indicia by the background portion.

18. The method of claim 17 wherein the step of providing decorative indicia comprises providing decorative indicia having at least one high basis weight region having a basis weight greater than the average basis weight of the background portion.

19. The method of claim 18 wherein each decorative indicia comprises a low basis weight border disposed intermediate a high basis weight region and the background portion.

20. The method of claim 19 wherein the high basis weight regions associated with each decorative indicia comprise at least 70 percent of the surface area of the decorative indicia.

21. The method of claim 18 wherein each decorative indicia comprises at least one cell substantially enclosed by one or more high basis weight regions, the cell having an average basis weight less than the basis weight of the high basis weight regions.

* * * * *